US008172732B1

(12) United States Patent
Webber et al.

(10) Patent No.: US 8,172,732 B1
(45) Date of Patent: May 8, 2012

(54) EXERCISE MACHINE WITH TWO-DIRECTIONAL PIVOTING USER SUPPORT

(75) Inventors: Randall T. Webber, La Jolla, CA (US); Bruce Hockridge, San Diego, CA (US); Jeffrey O. Meredith, San Diego, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 557 days.

(21) Appl. No.: 12/179,412

(22) Filed: Jul. 24, 2008

Related U.S. Application Data

(60) Provisional application No. 60/952,132, filed on Jul. 26, 2007.

(51) Int. Cl.
*A63B 21/08* (2006.01)

(52) U.S. Cl. ..... 482/97; 482/140

(58) Field of Classification Search ..... 482/93, 482/96, 97, 100, 136–138, 140, 146, 94, 482/95, 142
See application file for complete search history.

(56) References Cited

U.S. PATENT DOCUMENTS

| | | | | | |
|---|---|---|---|---|---|
| 3,207,464 | A | | 9/1965 | Hrach | |
| 3,367,613 | A | | 2/1968 | Christensen | |
| 3,999,702 | A | | 12/1976 | Conroy | |
| 4,387,893 | A | * | 6/1983 | Baldwin | 482/137 |
| 4,623,144 | A | | 11/1986 | Rockwell | |
| 4,627,619 | A | | 12/1986 | Rockwell et al. | |
| 4,729,562 | A | | 3/1988 | Pipasik | |
| 4,836,536 | A | | 6/1989 | Jones | |
| 5,007,675 | A | | 4/1991 | Musto et al. | |
| 5,052,684 | A | * | 10/1991 | Kosuge et al. | 482/118 |
| 5,056,779 | A | | 10/1991 | Webb | |
| 5,094,449 | A | * | 3/1992 | Stearns | 482/130 |
| 5,167,364 | A | | 12/1992 | Wenning | |
| 5,346,447 | A | | 9/1994 | Stearns | |
| 5,360,383 | A | | 11/1994 | Boren | |
| 5,577,987 | A | | 11/1996 | Brown | |
| 5,665,041 | A | | 9/1997 | Hsieh | |
| 5,669,865 | A | * | 9/1997 | Gordon | 482/142 |
| 5,681,250 | A | | 10/1997 | Hoover et al. | |
| 5,692,997 | A | | 12/1997 | Stearns | |
| 5,702,332 | A | | 12/1997 | Hsieh | |
| 5,749,813 | A | | 5/1998 | Domzalski | |
| D408,875 | S | | 4/1999 | Anderson | |
| 5,902,220 | A | | 5/1999 | Lin | |
| 5,938,575 | A | | 8/1999 | Stearns | |

(Continued)

OTHER PUBLICATIONS

Owner's Manual for Hoist S-602 Torso Rotator, pp. 1, 3, 5, 8, 13 and 14, dated Sep. 1997.

(Continued)

*Primary Examiner* — Loan Thanh
*Assistant Examiner* — Tam Nguyen
(74) *Attorney, Agent, or Firm* — Procopio, Cory, Hargreaves & Savitch LLP

(57) ABSTRACT

An exercise machine has a user support movement arm rotatably mounted on a support frame for rotation about a first pivot axis, and a user support assembly pivotally connected to the movement arm for rotation about a second pivot axis so that the user support assembly rotates in two directions about different pivot axes. An exercise arm pivotally mounted on the frame is linked to the user support assembly or user support movement arm so that movement of the exercise arm automatically moves the user support assembly. Movement about one pivot axis may be a free pivoting, non-resisted movement while movement about the other pivot axis may be associated with a resistive load.

33 Claims, 26 Drawing Sheets

U.S. PATENT DOCUMENTS

| | | | | |
|---|---|---|---|---|
| 6,003,944 | A | 12/1999 | Glockl | |
| 6,015,370 | A * | 1/2000 | Pandozy | 482/97 |
| 6,168,557 | B1 | 1/2001 | Liao | |
| 6,186,926 | B1 | 2/2001 | Ellis | |
| 6,248,047 | B1 | 6/2001 | Abdo | |
| 6,379,289 | B1 | 4/2002 | Gossie | |
| 6,468,191 | B1 | 10/2002 | Cameron | |
| 6,475,120 | B2 | 11/2002 | Johnston | |
| 6,475,123 | B1 | 11/2002 | Evans | |
| 6,478,721 | B1 | 11/2002 | Hunter | |
| 6,491,611 | B1 | 12/2002 | Stearns | |
| RE38,057 | E * | 4/2003 | Pandozy | 482/97 |
| 6,544,154 | B2 | 4/2003 | Forcillo | |
| 6,575,884 | B1 | 6/2003 | Eazor | |
| 6,676,573 | B2 | 1/2004 | Abelbeck et al. | |
| 6,752,748 | B1 * | 6/2004 | Scotti | 482/140 |
| 6,896,643 | B2 * | 5/2005 | Durfee, Jr. | 482/100 |
| 6,966,872 | B2 * | 11/2005 | Eschenbach | 482/142 |
| D513,293 | S | 12/2005 | Panatta | |
| D520,084 | S | 5/2006 | McVay et al. | |
| 7,115,081 | B2 * | 10/2006 | Stearns | 482/140 |
| 7,150,702 | B2 | 12/2006 | Webb et al. | |
| 7,220,221 | B2 | 5/2007 | Mosimann et al. | |
| 7,494,181 | B2 | 2/2009 | Tucker | |
| 7,621,860 | B2 * | 11/2009 | Burrell | 482/142 |
| 7,867,149 | B1 * | 1/2011 | Webber et al. | 482/97 |
| 2004/0204298 | A1 | 10/2004 | Chen | |
| 2005/0168017 | A1 | 8/2005 | Pernicka et al. | |
| 2006/0166799 | A1 | 7/2006 | Boland et al. | |
| 2006/0211549 | A1 * | 9/2006 | Nohejl | 482/97 |
| 2006/0281610 | A1 * | 12/2006 | Perez | 482/130 |
| 2008/0085822 | A1 * | 4/2008 | Webb et al. | 482/140 |

OTHER PUBLICATIONS

Specification and Drawings for U.S. Appl. No. 12/179,425, filed Jul. 24, 2008.

Ab Doer Extreme, web page, http://www.asseenontv.com/prod-pages/ab_doer_xtrm.html?gid=, printed Jun. 25, 2008, earliest date unknown.

Ab Lounge, web page, http://ecx.images-amazon.com/images/I/4165nz401SI.SS500, printed Jun. 25, 2008, earliest date unknown.

Ab Zone, web page, http://www.asseenontv.com/prod-pages/abzne_ontv.html, printed Jun. 25, 2008, earliest date unknown.

Ab Rocket Abdominal Trainer, Amazon.com, http://www.amazon.com/gp/product/images/B000SALE1Q/ref=dp_otherviews_3?ie=UTF, printed Jun. 25, 2008, earliest date unknown.

Multi-Hinge Ab Crunch, Amazon.com, http://www.ecx.images-amazon.com/images/I/31MoMOIJHbL_SS500.jpg, printed Jun. 25, 2008, earliest date unknown.

Body Flex Clark Bartram's 3D Abs, web page, http://www.amazon.com/gp/product/images/B0007U9CRU/ref=dp_otherviews_1?ie=UTF, printed Jun. 25, 2008, earliest date known.

Red Seat, web page, http://ecx.images-amazon.com/imagesI/41FAV4zctWI.SS500.jpg, printed Jun. 25, 2008, earliest date known.

Abcore, Abcore Fitness 2005, web page, http://www.fitnessabcore.com/photos.htm#, printed Jan. 5, 2006, earliest date known.

Ab Coaster, Advertisement, Printed Jun. 28, 2010.

Cybex Ab Crunch, Cybex Brochure 2001.

F-609 Abdominal Machine and F-611 Ab Flexor, Flex Brochure 1995.

Hoist HS1350 Rotary Torso and HS1310 Ab Crunch, Hoist Fitness Systems Brochure, 2005.

Posi-trak Work-Out Bench, Positrak Brochure, Printed Jun. 28, 2010.

Abdominal Machine, Nautilus Brochure, 1997.

Power Crunch, Quantum Brochure, 2004.

03008 Abdominal Machine, Gym 80 Brochure, printed Jun. 28, 2010.

07008 Abdominal Machine, Gym 80 Brochure, 2001.

08005 Abdominal Multi-Joint Machine, Gym 80 Brochure, 2001.

712 Abdominal isolator, Icarian Brochure, Printed Jun. 28, 2010.

Specification and Drawings for U.S. Appl. No. 12/170,425, filed Jul. 24, 2008.

* cited by examiner

EXERCISE MACHINE WITH TWO-DIRECTIONAL PIVOTING USER SUPPORT

RELATED APPLICATION

The present application claims the benefit of U.S. provisional patent application No. 60/952,132 filed Jul. 26, 2007, which is incorporated herein by reference in its entirety.

BACKGROUND

1. Field of the Invention

This invention relates generally to an exercise machine, and is particularly concerned with an exercise machine which has a pivoting user support providing two directions of pivoting movement.

2. Related Art

Exercise machines with pivoting user supports typically provide for movement in one direction or plane about one pivot axis. Some abdominal exercise machines have a raised seat assembly which has an upper torso engaging structure that allows the exerciser to bend forwardly into a simulated crunch position against a variable resistance. One such machine is described in U.S. Pat. No. 6,186,926 of Ellis. In these machines, there may be some difficulty for the user in maintaining their body in the same position during the exercise movement.

Therefore, what is needed is a system and method that reduces or overcomes these significant problems found in the conventional systems as described above.

SUMMARY

An exercise apparatus in one embodiment comprises a user support or seat that can be pivoted simultaneously about perpendicular pivot axes.

The exercise apparatus in one embodiment comprises a support frame, a user support movement arm pivoted on the frame for rotation about a first pivot axis, a user support assembly pivotally mounted on the user support movement arm for rotation about a second pivot axis, an exercise arm pivotally mounted for rotation about a third pivot axis and a connecting linkage which translates movement of the exercise arm into movement of the user support assembly in a first direction. Rotation of the user support assembly about the second pivot axis results in movement in a second direction, and this movement may be controlled by the user in one embodiment, while movement in the first direction is controlled by the exercise arm. A load may be linked to one of the moving parts to provide exercise resistance, with the user's body weight also providing resistance to movement about the first pivot axis. The load may be linked to the exercise arm or to the user support movement arm.

The two directions of movement may be in different planes so that simultaneous movement of the user support in both directions can simulate a circular movement. In one embodiment, the first and third pivot axes are perpendicular to the second pivot axis. One of the movements may be associated with a resistive load, while the other is free-pivoting, non-resisted movement. This provides a hybrid movement that combines a free pivoting, non-resistive movement with an automatic, load-bearing movement.

In one embodiment, the user support assembly has a primary support, a secondary support, and a stabilizing support that travel together during an exercise movement. The primary support is a user seat in one embodiment, while the secondary support is a tail bone or lower back support pad secured to a rear end of the user seat, and the stabilizing support is designed to stabilize the user's lower legs during the exercise movement.

The exercise arm in one embodiment is an upper torso engaging structure which may have a back pad and which has one or more handles at its upper end for gripping by a user seated on the user seat with their lower back against the lower back or tail bone support pad. In one embodiment, the exercise arm is mounted for pivoting relative to the user support assembly while it is linked to the user support assembly by the connecting link so that pulling down on the handles also lifts the user seat towards the back pad, placing the user in an abdominal crunch position. At the same time, the seat is free swiveling due to the pivotal mounting on the user support arm. The free swiveling movement of the seat is controlled by the user, and the user can pivot the seat from side to side as the exercise arm is pivoted to perform the exercise, or alternatively may try to prevent the seat from swiveling as the abdominal exercise is performed. The end result is a movement pattern that provides simultaneous vertical and horizontal seat movement that involves multiple muscle groups and requires multiple joint actions.

In one embodiment, the apparatus is designed for performing abdominal crunch exercises moving the user's upper body towards their lower body. However, in alternative embodiments, the apparatus may be adapted for performing other exercise movements designed to exercise muscles in the upper or lower body, and could be arranged so that the upper body moves towards the lower body, away from the lower body, or in a fixed relationship to the position of the lower body. Regardless of the type of exercise performed, balancing on a moving seat and controlling its swiveling action requires core stabilizing muscles in the abdominal and back area to be involved in the exercise.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for exercise machines with a raised pivoting seat or user support, designed for performing various types of exercises. In certain embodiments disclosed herein, a pivoting user support is linked to an exercise arm for movement with the arm about a first pivot axis, and is also freely rotatable in a swiveling movement about a second pivot axis.

After reading this description it will become apparent to one skilled in the art how to implement the invention in various alternative embodiments and alternative applications. However, although various embodiments of the present invention will be described herein, it is understood that these embodiments are presented by way of example only, and not limitation.

Figure 13A:
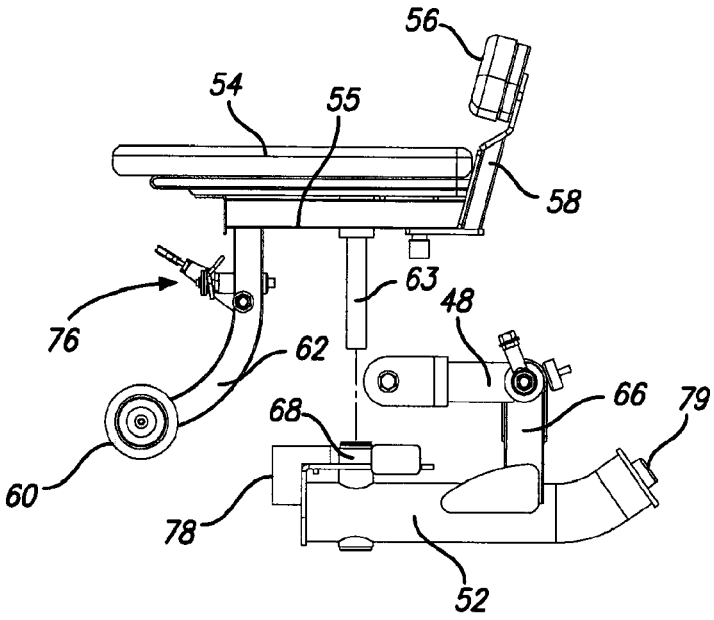
FIG. 13A is an exploded side elevation view illustrating how the user support assembly pivotally mounts to the movement arm in the machine of FIGS. 1 to 10.
Figure 13B:
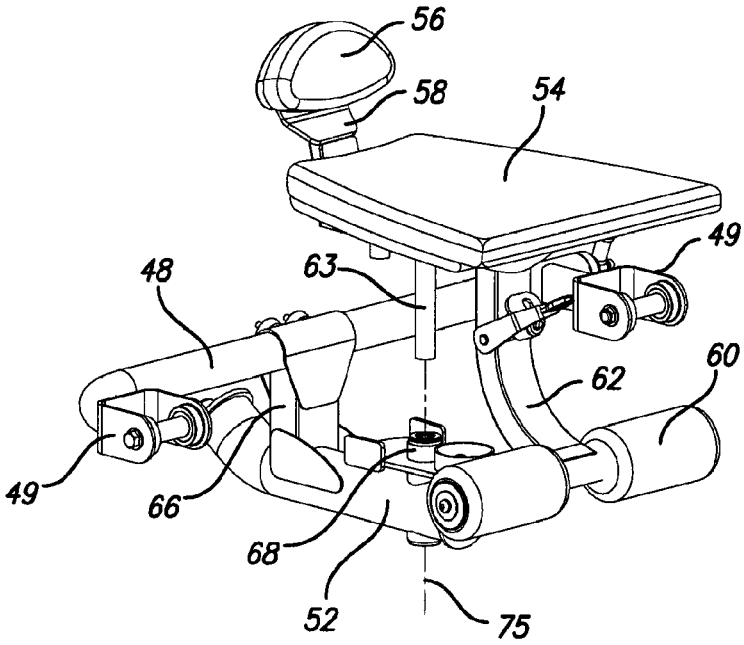
FIG. 13B is a front perspective view of the separated components of FIG. 13A.

FIGS. 1 to 10 illustrate an exercise machine 10 with a raised, pivoting user support or seat assembly 12 according to a first embodiment, while FIGS. 13*a* and 13*b* illustrate some separated components of the machine in more detail, and FIGS. 21 to 24 illustrate different types of exercise which can be performed.

In one embodiment, machine 10 has a main frame 14 on which the user support assembly 12 is pivotally supported at a location spaced above the ground. The user support assembly is pivoted for movement about two different pivot axes via a user support movement arm 52, as explained in more detail below. A pivoted exercise arm assembly 15 is linked to the user support assembly by a connecting link 16 to control movement about one of the pivot axes.

Figure 1:
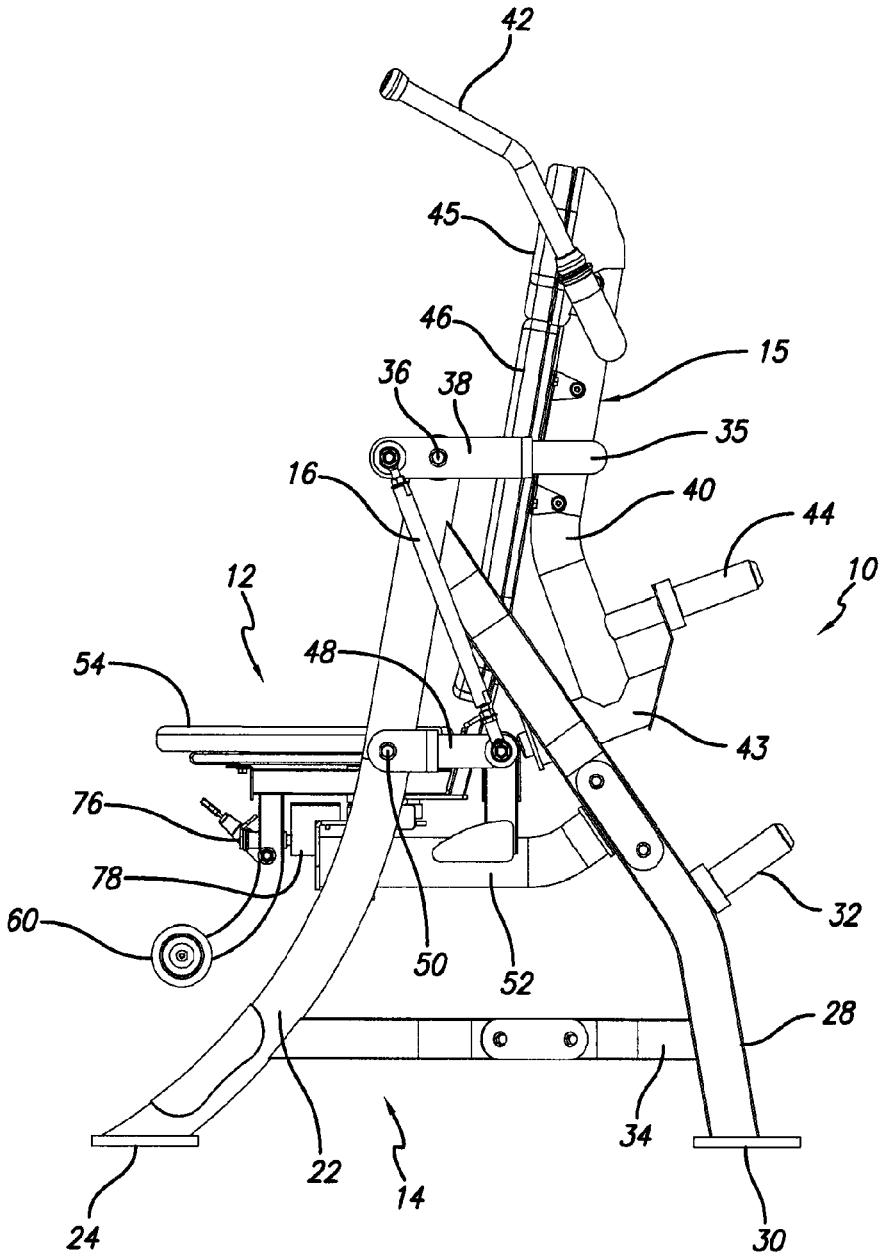
FIG. 1 is a side elevation view of a first side of an abdominal exercise machine according to a first embodiment in an exercise start position.
Figure 2:
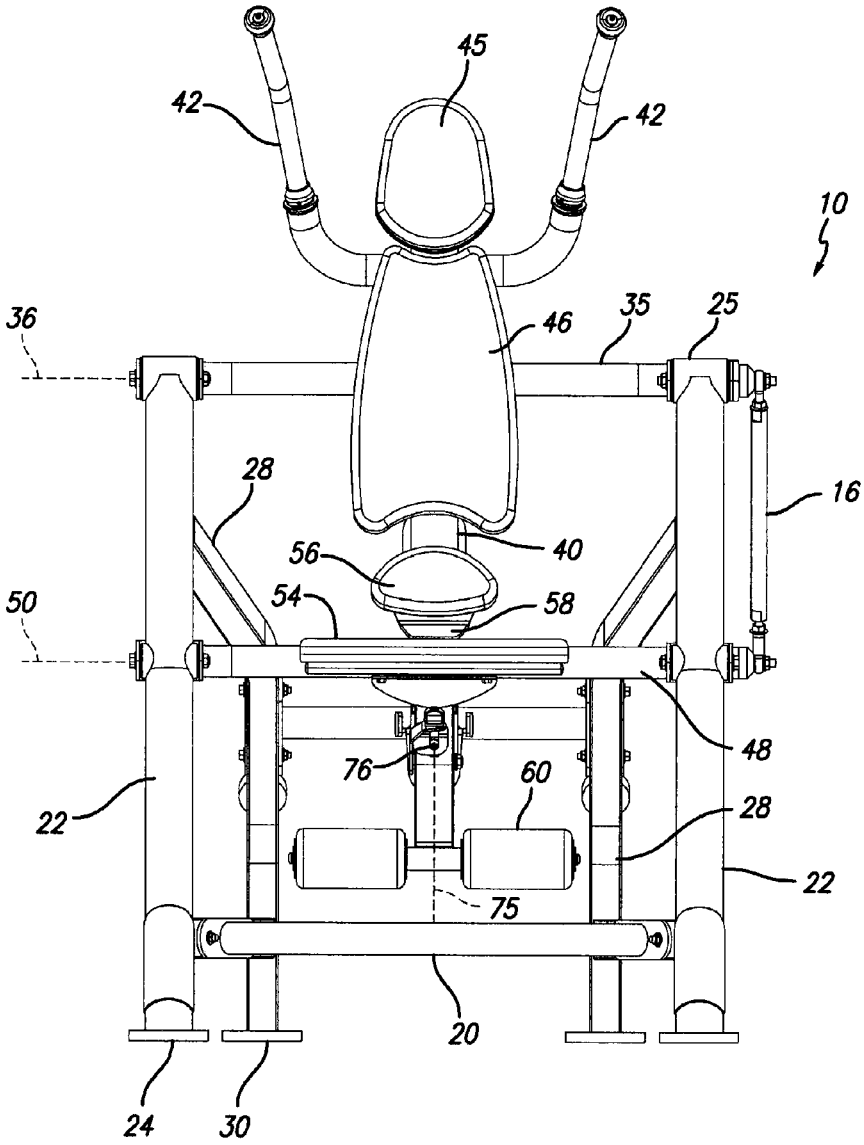
FIG. 2 is a front view of the machine of FIG. 1.
Figure 3:
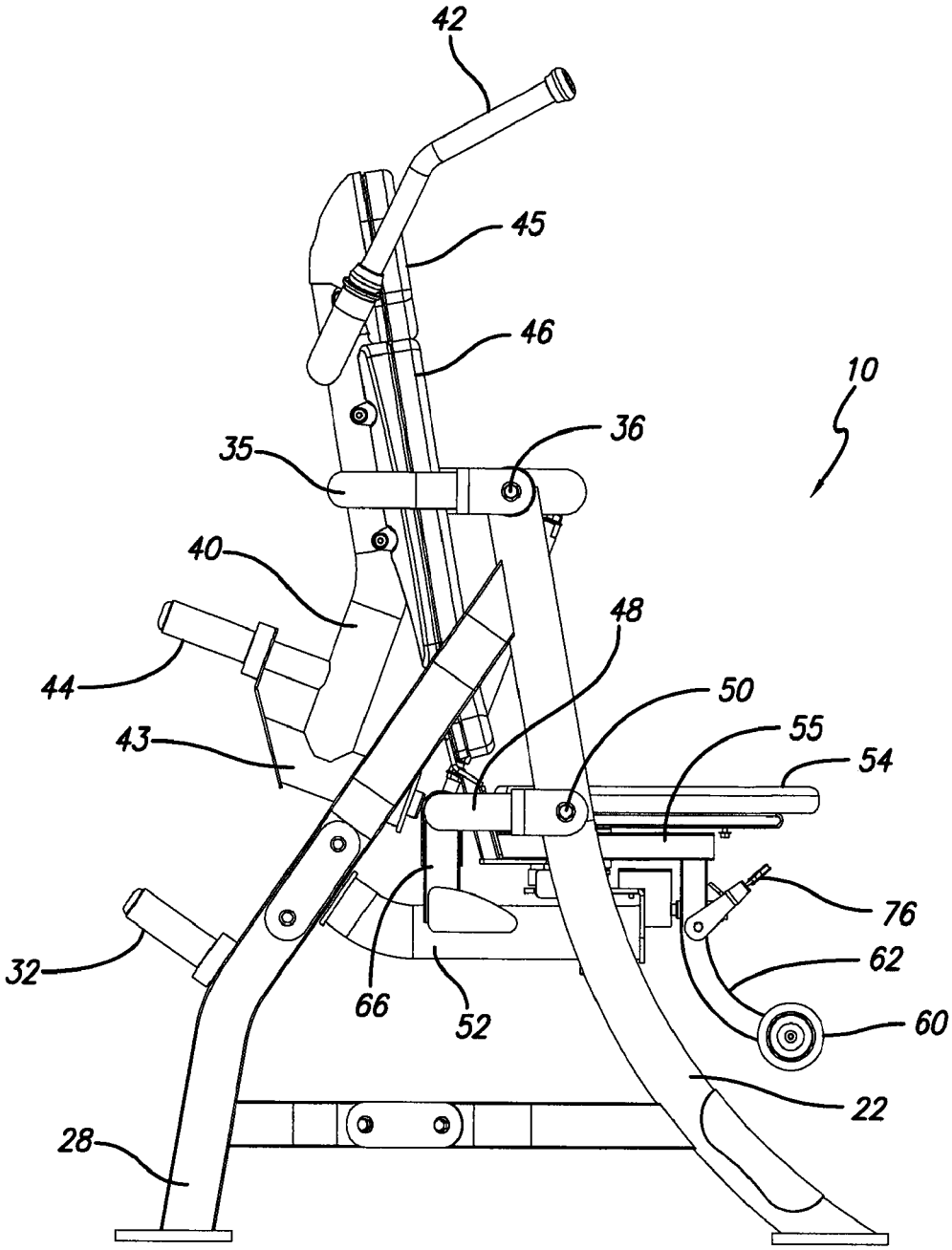
FIG. 3 is a side elevation view of the second, opposite side of the machine of FIG. 1.
Figure 4:
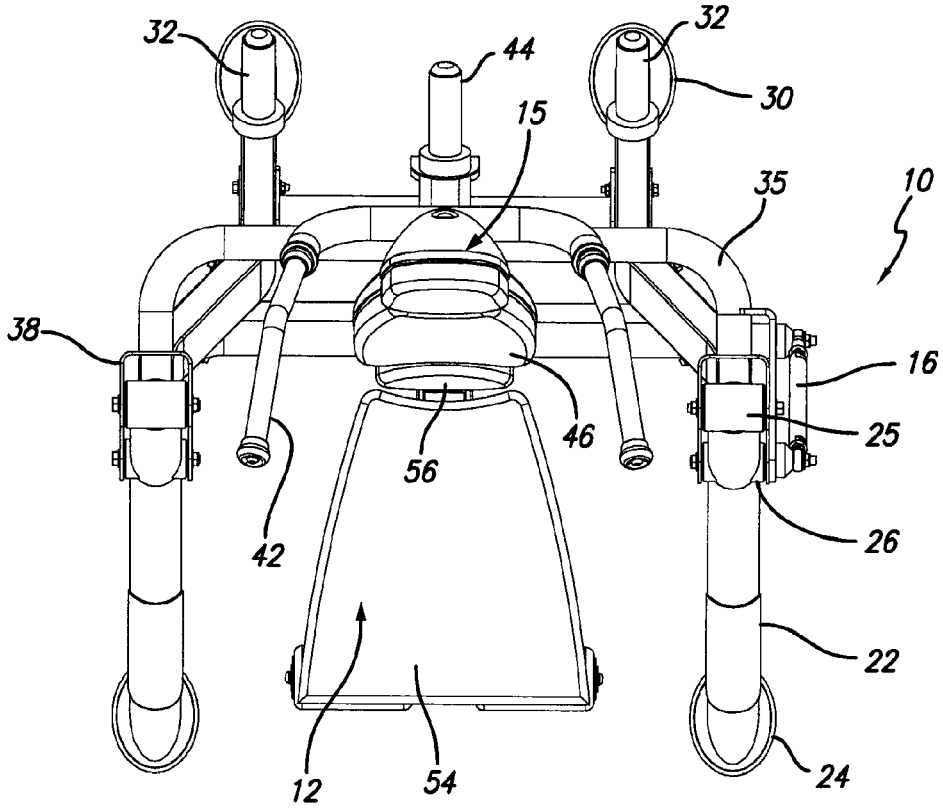
FIG. 4 is a top plan view of the machine of FIGS. 1 to 3.
Figure 5:
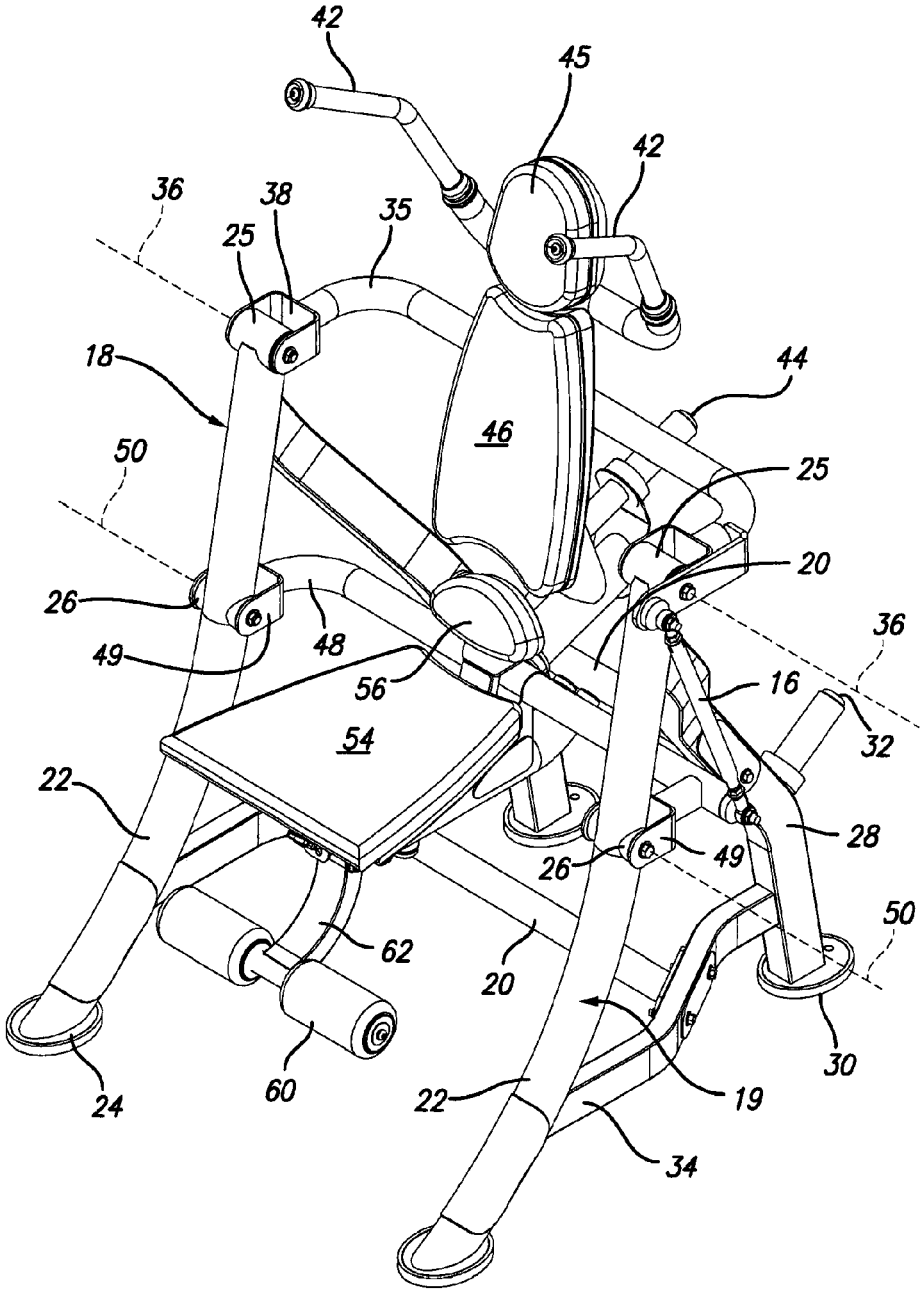
FIG. 5 is a front perspective view of the machine of FIGS. 1 to 4.
Figure 6:
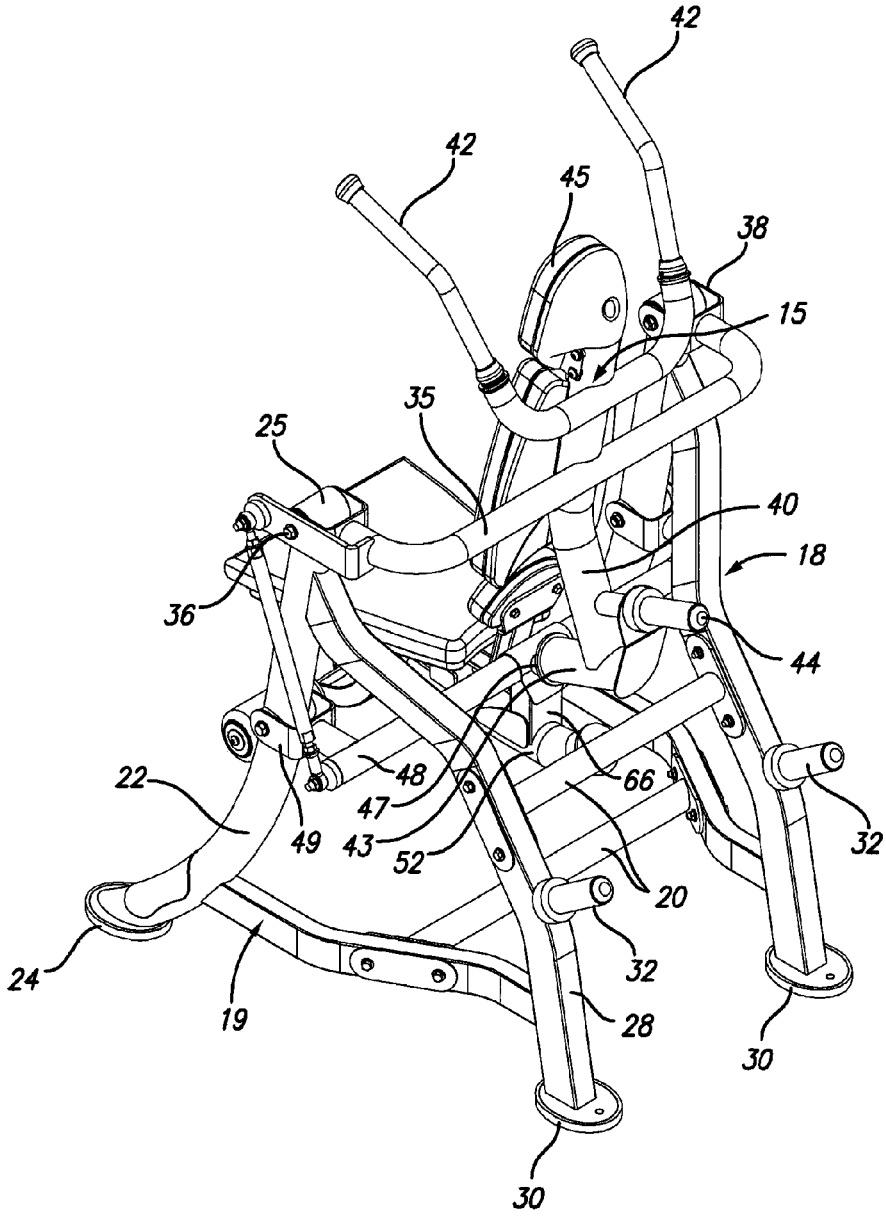
FIG. 6 is a rear perspective view of the machine of FIGS. 1 to 5.

The main frame has right and left side sections 18, 19 joined together by cross struts 20, as best seen in FIGS. 5 and 6. Each side section has a main upright 22 with a floor engaging foot 24 at the lower end and a first pivot mount 25 at the upper end or in the vicinity of the upper end. A second pivot mount 26 is located on the main upright at a location spaced below the first pivot mount 25. A supporting upright 28 is positioned rearward of the main upright and also has a floor engaging foot 30 at the lower end. Supporting upright 28 is joined at the upper end to the main upright below the first pivot mount 25, as illustrated in FIG. 1. A weight plate storage peg 32 is mounted on the rear side of each supporting upright to store hand loaded weight plates when they are not being used in the performance of the exercise. A support tube 34, positioned above the floor engaging feet 24, 30, joins the front and rear uprights.

A first pivoting cross strut 35 has opposite ends pivotally mounted to the first pivot mounts 25 on each main upright for rotation about a first horizontal pivot axis 36. The cross strut is "U" shaped with "U" shaped pivot mounting brackets 38 at each end. The exercise arm assembly 15 is mounted to the central web section of the first cross strut, as best illustrated in FIGS. 1 and 6. The exercise arm assembly in this embodiment comprises an upright tube or rod 40 with a pair of user engaging handles 42 mounted approximate the upper end of the upright, a load receiving peg 44 mounted approximate the lower end of the upright, and an upper torso engaging assembly comprising head and upper back pads 45, 46 mounted on the front side of the upright. A lower strut or member 43 extends across the lower end of upright rod 40, and a stop or bumper 47 is located at the forward end of member 43. The rear end of member 43 may be connected to the load receiving peg 44 by a connecting plate, as illustrated in FIG. 6, for added stability.

A second pivoting cross strut 48 has opposite ends pivotally mounted to second pivot mounts 26 on each main upright for rotation about a second horizontal pivot axis 50, at a location spaced below the first pivot mounts. The second cross strut is also of a general "U" shape with "U" shaped pivot mounting brackets 49 at each end. Connecting link 16 is pivotally connected to the first and second cross struts at its opposite ends on one side of the support frame, as best illustrated in FIGS. 1, 5 and 6. The user support movement arm 52 is mounted on the central web section of U-shaped cross strut 48 so that it pivots with the strut, and the user support assembly 12 is pivotally mounted on arm 52 and moves with the arm as the arm pivots about axis 50, as described in more detail below with reference to FIGS. 13*a* and 13*b*. Stop or bumper 47 at the lower end of the exercise arm upright 40 engages the cross strut 48 when in the start position to avoid contact between the pivoting exercise arm and seat when the arm is released by a user (see FIG. 6).

Figure 7B:
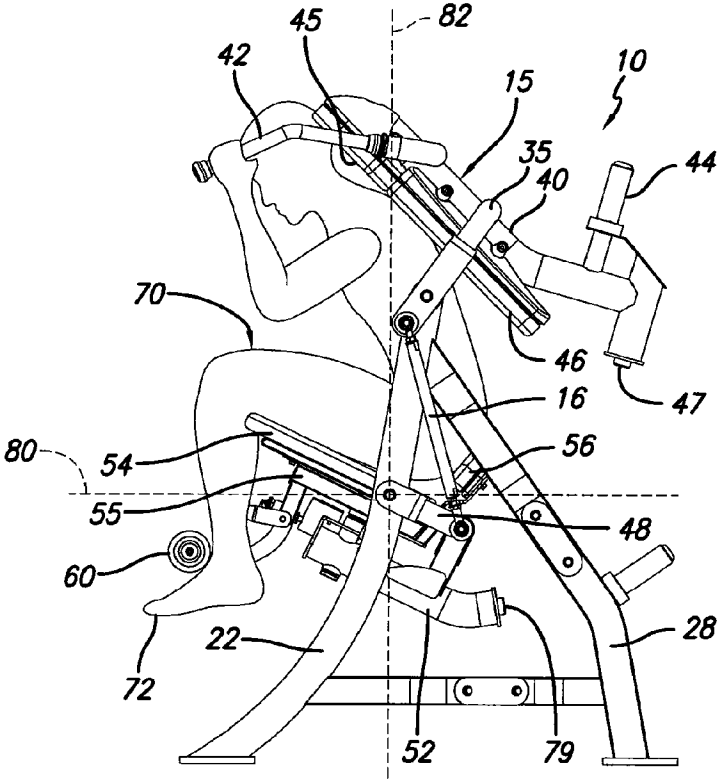
FIG. 7B is a side elevation view similar to FIG. 7A illustrating an exercise finish position.
Figure 7A:
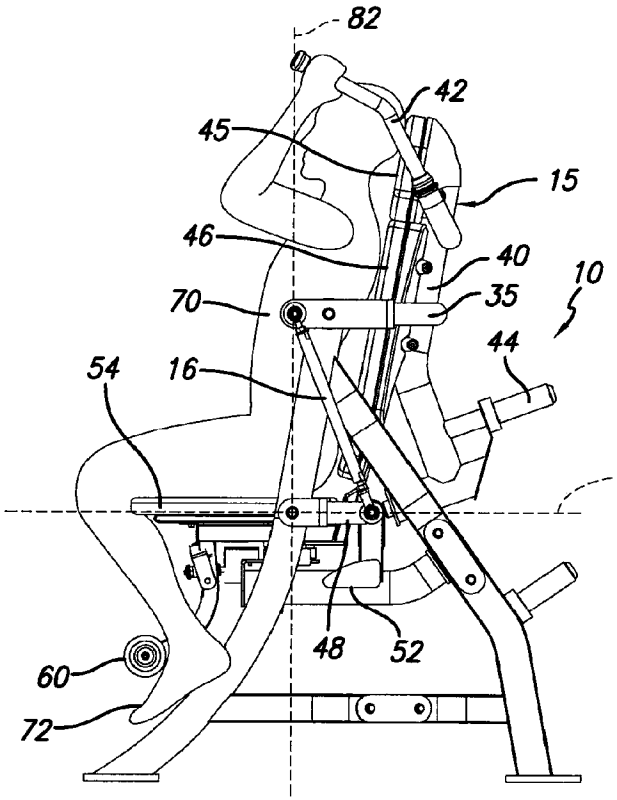
FIG. 7A is a side elevation view similar to FIG. 1 illustrating a user seated on the machine ready to perform an abdominal crunch exercise.
Figure 11B:
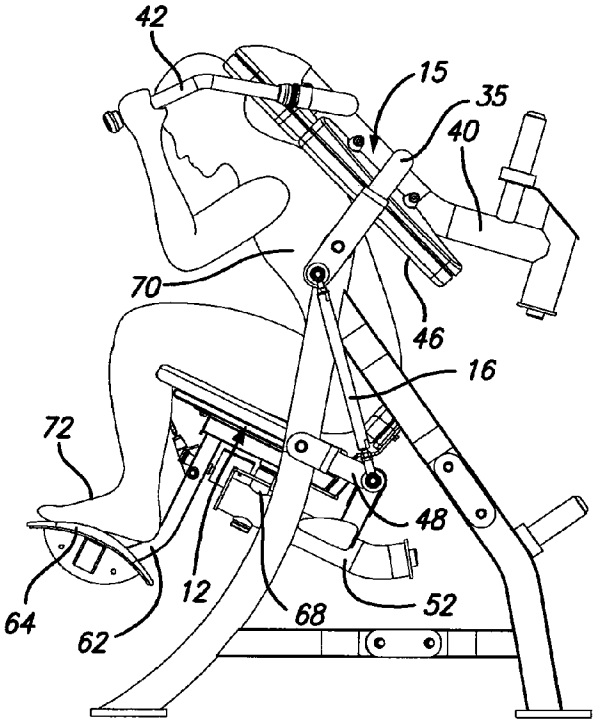
FIGS. 11A and 11B are side elevation views similar to FIGS. 7A and 7B but illustrating a modified exercise machine in which the roller pads of FIGS. 1 to 10 are replaced by foot plates.
Figure 11A:
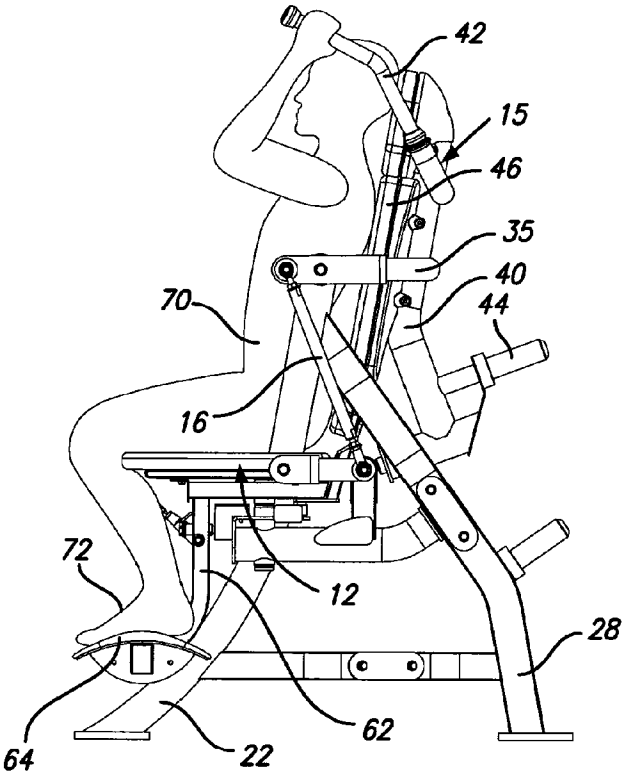
Figure 12B:
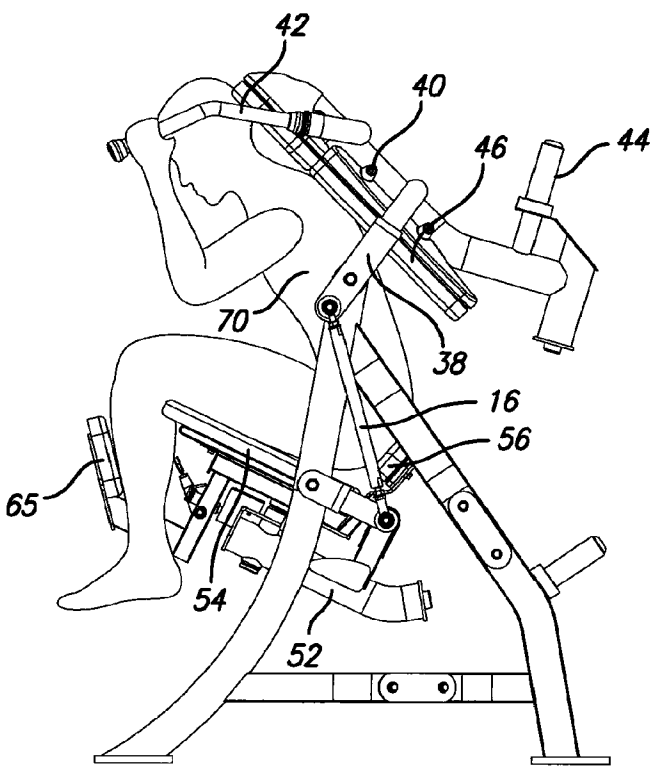
FIGS. 12A and 12B are side elevation views similar to FIGS. 7A and 7B but illustrating a modified exercise machine in which the roller pads of FIGS. 1 to 10 are replaced by knee or shin pads.
Figure 12A:
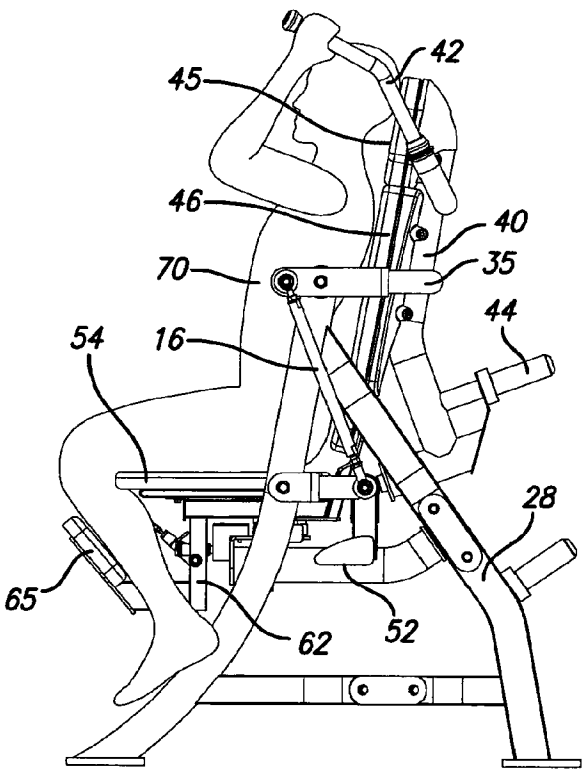

As best illustrated in FIGS. 13A and 13B, the user support assembly 12 is pivotally mounted on user support movement arm for swiveling about a pivot axis 75. The user support assembly in this embodiment comprises a primary user support 54 mounted on user support or base tube 55, a secondary user support 56 supported on an upward projecting support tube 58 mounted approximate the rearward end of the base tube for supporting the secondary user support, and a stabilizing support 60 mounted on a downward projecting support tube 62 which is mounted approximate the forward end of the base tube. A pivot axle 63 extends downwardly from the user support or base tube 55 at a location between the upward and downward projecting tubes for engagement in an upwardly directed pivot mount or sleeve 68 on the movement arm 52, as best seen in FIG. 13A. In this embodiment, the primary user support 54 is a seat pad, the secondary user support 56 is a lower back or tail bone pad positioned to engage the lower back or tailbone of a user seated on seat pad 54, and the stabilizing support 60 comprises a pair of roller pads designed to engage over the feet 72 of a user 70 when seated on the support assembly, as illustrated in FIGS. 7A and 7B. In alternative embodiments, the stabilizing support may alternatively comprise one or more foot plates 64 on which the user's feet rest, as illustrated in FIGS. 11A and 11B, or one or more knee or leg pads 65 designed to engage in front of the user's knees or shins, as illustrated in FIGS. 12A and 12B. In another embodiment (not illustrated), a pad may be provided between the user's knees or thighs, and the user may use his knees to swivel the seat. In this case, the legs may dangle freely from the seat.

The user support movement arm 52 has an upwardly projecting strut 66 at a location spaced between its front and rear ends which is secured to the pivoting cross member 48 on the main frame, as best illustrated in FIGS. 6 and 13B. The pivot mount or sleeve 68 adjacent the forward end of arm 52 receives the pivot axle 63 so that the user support seat assembly 12 can pivot or swivel relative to movement arm 52 about pivot axis 75 which extends perpendicular to seat pad 54. To prevent the user support seat (or the user seated in the seat) from contacting the main frame, stops can be placed to limit the side to side pivot. Because entering and exiting a free swiveling seat can be awkward, a locking device 76 may be used to temporarily secure the seat in a centered, forward facing orientation. Locking device 76 has a pin which can be selectively engaged in an opening in a forward member 78 mounted on the user support movement arm 52 when the seat is in a centered position, as illustrated in FIGS. 1 and 13A. In one embodiment, the locking device may be biased into locking engagement with an aligned opening or notch at the forward end of movement arm 52 when the seat is in a central position. A ramping device may guide the pin to the central, locking position. The seat may be angled such that it tends to fall back to the central position after swiveling. A stop or bumper 79 on the rear end of the user support movement arm engages the cross strut 20 extending between the main frame supporting uprights 28 when the machine is in the start position of FIGS. 1, 5 and 6.

Figure 8:
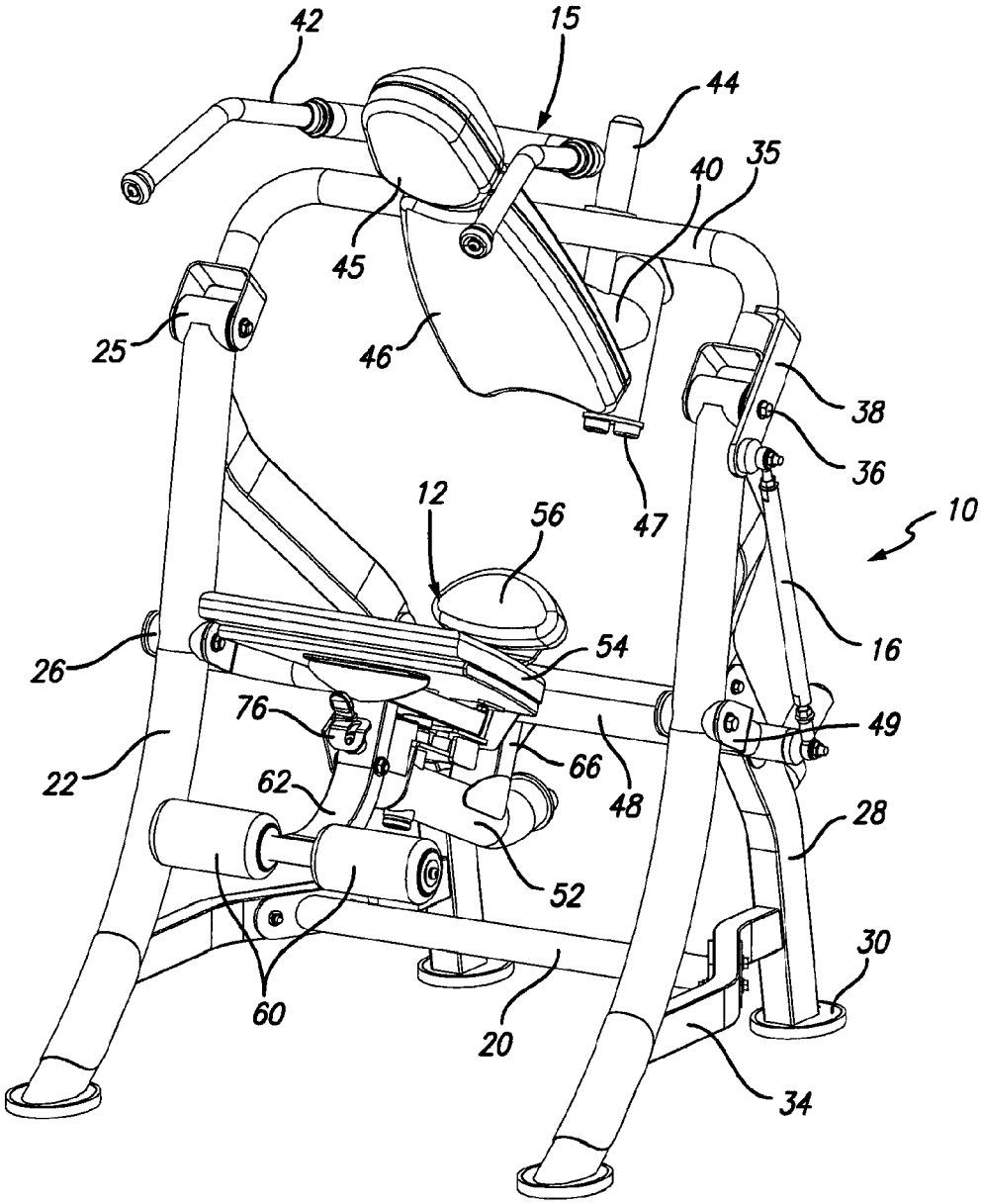
FIG. 8 is a front perspective view of the machine in the exercise finish position of FIG. 7B.

FIGS. 7A and 7B illustrate a side view of a user 70 performing an abdominal crunch exercise. They represent the start and finish positions for the exercise movement. FIG. 8 illustrates the finish position of FIG. 7B without the user, so as to show the relative positions of the moving parts more clearly. The dotted lines in FIGS. 7A and 7B represent the horizontal and vertical centerlines 80, 82 of the user support pivot 50. FIG. 7A shows the user starting with the seat pad slightly inclined relative to the horizontal centerline, with their knees at a higher elevation than their hips. It also shows how the tail bone pad 56 aligns the user with the user engaging back pad 46 of the exercise arm.

To perform an exercise, the user 70 (see FIG. 7A) sits on the seat or primary support 54 with their buttock up against the tail bone pad or secondary support 56, knees bent over the front edge of the seat pad and their feet 72 hooked behind the stabilizing roller pads 60. The user then unlocks the user support assembly 12 from the movement arm 52 (in machines where lock assembly 76 is provided). Next, the user leans back against the user engaging pads 45, 46 on the exercise arm 15, grabs the user engaging handles 42 and pulls the handles forward in a downward motion. This action pulls the user engaging pads 45, 46 into contact with the user's head, upper back and shoulders, pushing them forward and downward and causing the user's upper body to bend just below the rib cage and activate the upper abdominal muscles. At the same time, the connecting link 16 attached to the exercise arm is pushed down by pivotal movement of pivoting cross strut 35 in an anti-clockwise direction about pivot axis 36, simultaneously pushing the lower pivoting cross strut 48 to pivot downwardly in a clockwise direction about pivot axis 50. This simultaneously pivots the rear end of the user support movement arm 52 downwards and lifts the forward end of the arm upward in a rearward direction, simultaneously tilting the user support upward and rearward. This movement lifts the user's knees while it lowers the user's hips, causing the user to bend forward at the waist as seen in FIG. 7B, activating the lower abdominal muscles. The combined movement of upper and lower body produces a compound movement abdominal exercise. A small amount of resistance is supplied by the weight of the user seated on the user support, which is raised at the front end when the exercise arm is moved. This resistance is only slight because part of the user's weight passes through the gravitational center line 82 as the user moves from the start position of FIG. 7A to the finish position of FIG. 7B, partially balancing the weight lifted at the forward end in front of center line 82. Additional resistance is supplied by adding weight plates to the receiving peg 44 on the lower section of the exercise arm upright. This vertical movement to the user support is automatic because the upper pivoting exercise arm and lower pivoting user support movement arm are directly linked via the connecting link 16.

Swiveling, side-to-side movement of the user support about pivot axis 75 is supplied by the pivotal connection to the user support movement arm 52, via pivot axle 63 which engages in pivot sleeve 68 as seen in FIGS. 1 and 13. This is an unrestricted, free-swiveling movement that is controlled by the user. It allows the user to pivot the seat from side to side as the user support movement arm 52 is pivoted by actuation of the exercise arm assembly, involving a greater number of torso muscles. Swiveling the knees to one side or the other involves the oblique muscles as well as the upper and lower abdominal muscles. Just trying to prevent the seat from swiveling and keeping it centered during the exercise movement requires core stabilizing muscles in the abdominal and low back area to become involved. The end result is a movement pattern that provides simultaneous vertical and horizontal seat movement that involves multiple muscle groups and requires multiple joint actions.

FIG. 7B shows how the user engaging pads force the user into a crunch position as the handles are pulled forward and how this action forces the user support movement arm 52 to angle upward as it pivots about its connection to the main frame at pivot 50. FIG. 7B also shows the user's knees rising and how their hips lower as they travel rearward, passing through the vertical centerline 82. FIGS. 7A and 7B also show how the seat pad 54 (primary support), tail bone pad 56 (secondary support) and transverse roller pads 60 (stabilizing support) all travel together in the same fixed orientation and how they keep the user in the same seated position throughout the exercise. The tail bone pad 56 resists the tendency of the user to slide rearward during the exercise as the angle of the user support increases, as seen in FIG. 13B. Rearward sliding of the user's body without pad 56 causes more of the user's weight to shift to the downhill side of the gravitational centerline and alters the exercise resistance. It could also prove uncomfortable, forcing the user to bind up in the finish position as well as sliding back and forth on the seat as the user moves in the first direction. With the tail bone pad, the user stays in the same position on the seat throughout the exercise. As seen in FIG. 8, in the exercise finish position the exercise arm assembly pivots upwardly and tilts forward, while the seat assembly pivots up and rearward.

Figure 9:
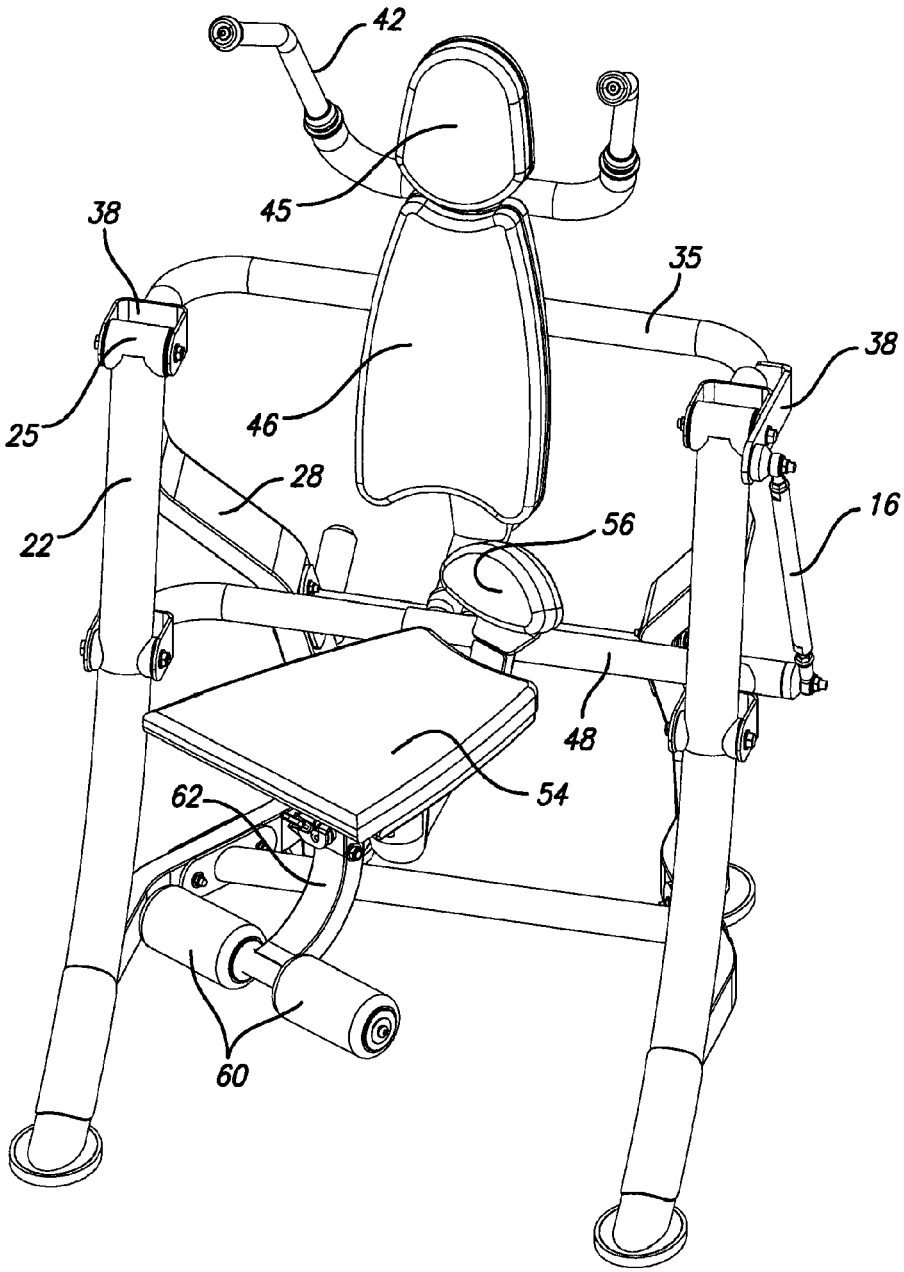
FIG. 9 is a front perspective view of the machine in a start position with the seat swiveled to one side.
Figure 10:
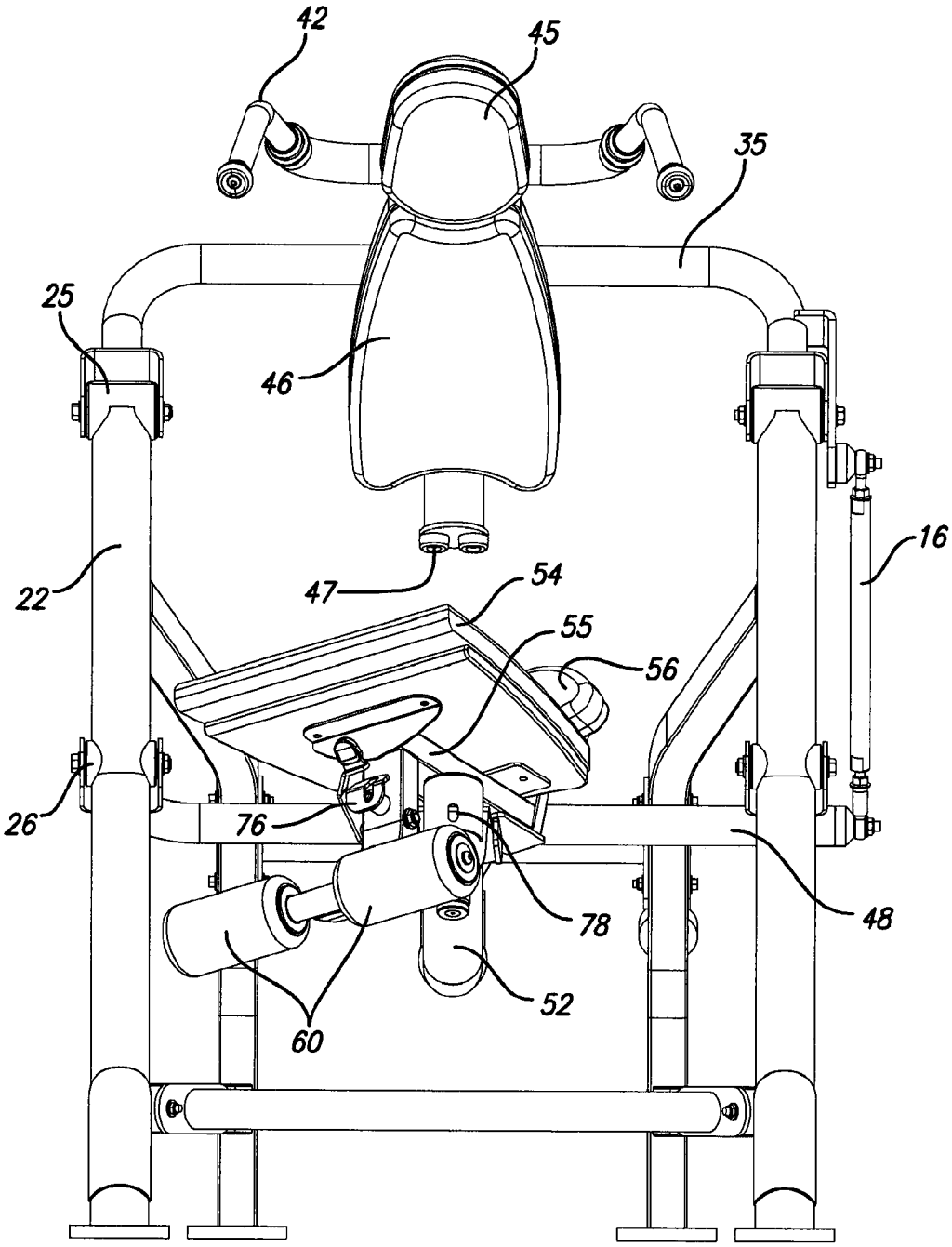
FIG. 10 is a front perspective view of the machine in an exercise finish position with the seat swiveled to one side.

FIGS. 9 and 10 illustrate the swiveling capability of the user support in more detail. FIG. 9 shows the machine in the start position but with the user support swiveled to one side while FIG. 10 shows a finish position in which the seat is swiveled. These figures show how the three components of the user support assembly swivel together in the same fixed orientation. This helps to keep the user in the same seated position during the swiveling as well as lifting movement. If the tail bone pad were stationary and did not move with the seat pad, the swiveling movement could cause abrasion by rubbing the user's tail bone against the pad. This abrading would increase as the seat is elevated during the exercise.

Figure 21B:
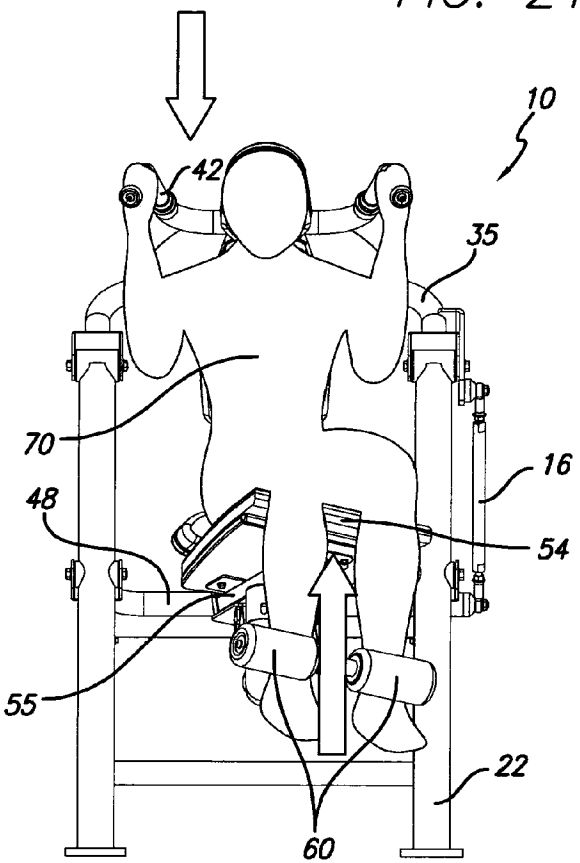
FIG. 21 is a schematic front view illustrating a user performing an oblique crunch exercise using the machine of FIGS. 1 to 10.
Figure 21A:
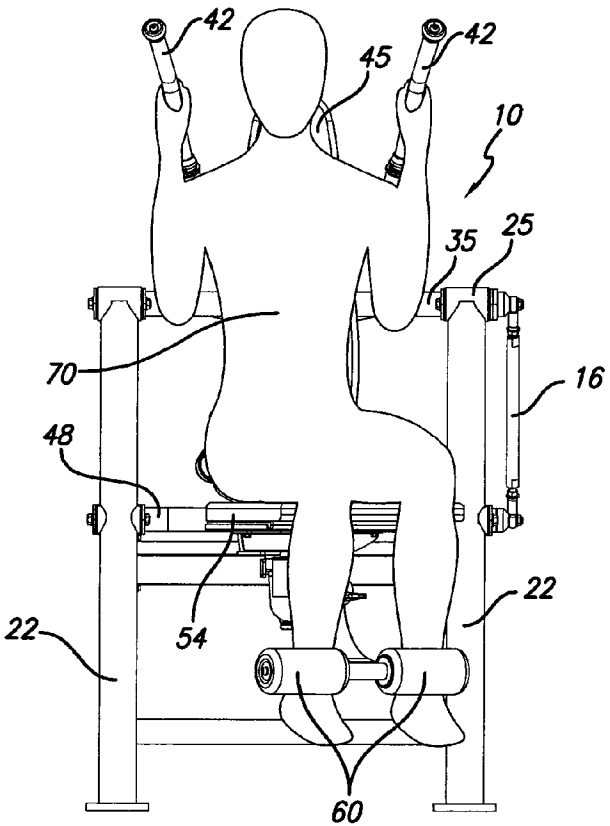

FIGS. 21 to 24 illustrate some alternative exercises which can be performed by a user seated on the machine 10. FIG. 21 illustrates the start and finish position of an oblique crunch. Although the user 70 twists to their left in FIG. 21, they may alternatively twist to the right in an equivalent manner, and may alternate exercises to the left and right in an exercise routine. In this exercise, the user sits with their back against the back pad and the seat unlocked to allow free swiveling movement, with the seat swiveled so that the knees are to one side of the body. The user grasps the handles 42 and places their feet behind the roller pads 60, and then pulls the handles down while pulling the roller pads upward.

Figure 22B:
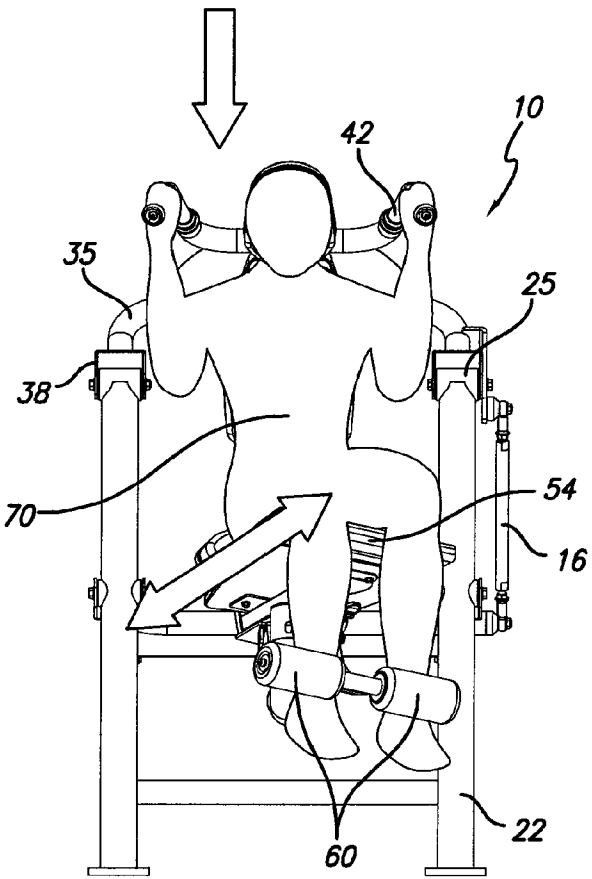
FIG. 22 is a schematic front view illustrating a user performing a twisting oblique exercise using the machine of FIGS. 1 to 10.
Figure 22A:
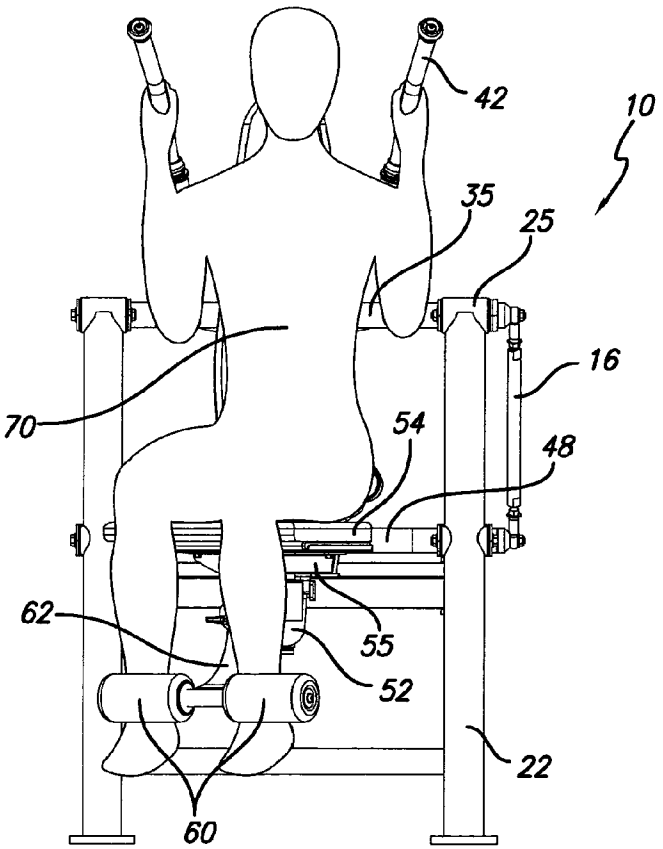

FIG. 22 illustrates a start and finish position for a twisting oblique exercise. In this exercise, a user sits with their back against the back pad and the seat unlocked to allow free swiveling, with the seat rotated so that the knees are to one side of the body. The user then grasps the handles and places their feet behind the roller pads. The handles are then pulled down while pushing the roller pads upward and across to the opposite side, simultaneously twisting the seat and the user's lower torso to the opposite side, before slowly returning to the start position.

Figure 23B:
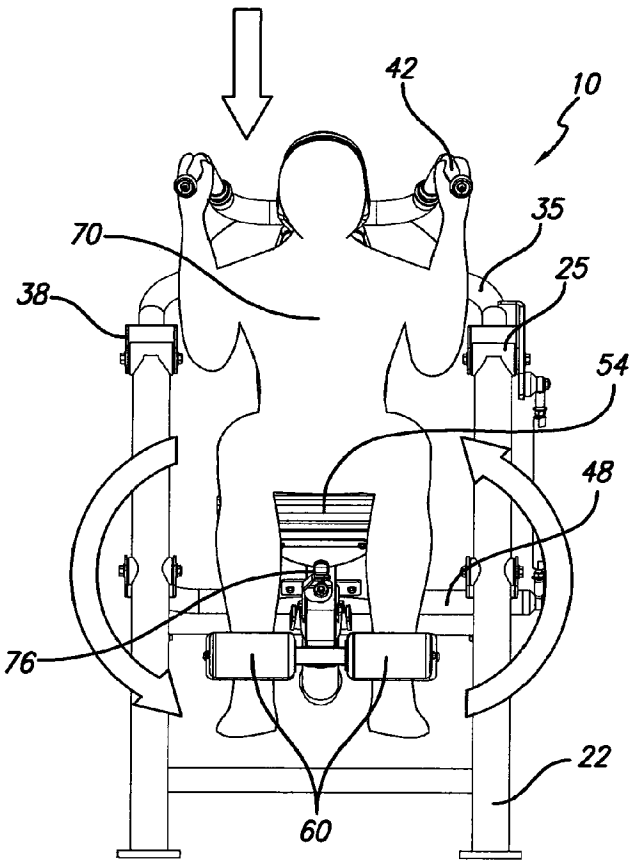
FIG. 23 is a schematic front view illustrating a user performing a rotating crunch exercise using the machine of FIGS. 1 to 10.
Figure 23A:
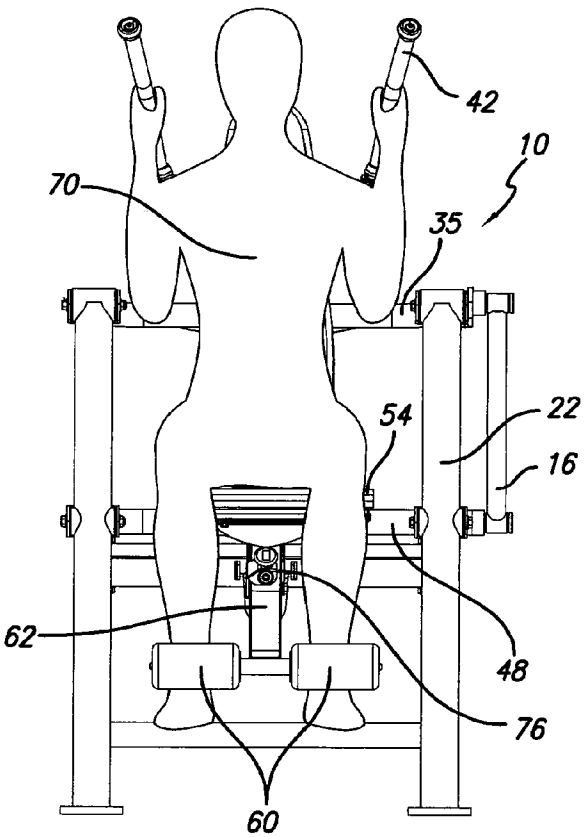

FIG. 23 illustrates the start and finish position of a rotating crunch exercise. The user sits on the seat pad with their back against the back pad and the seat in a central position, unlocked to allow free swiveling movement. The user grasps the handles and places their feet behind the roller pads. The handles are then pulled down while the feet are used to rotate the roller pads upward and around in a semi-circular motion, as illustrated by the arrow to the right hand side in the right hand, finish position view. The handles are then pushed up to lower the body while continuing to rotate the roller pads downward and around (see arrow to left hand side in finish position), completing the circular motion while returning to the start position illustrated on the left hand side of FIG. 23.

Figure 24B:
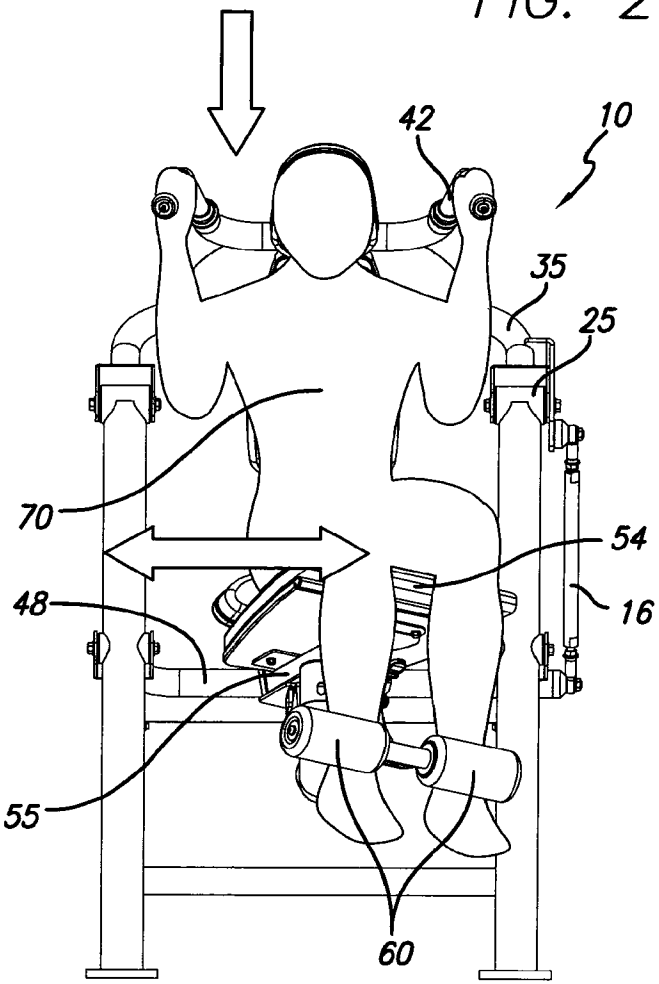
FIG. 24 is a schematic front view illustrating a user performing a torso rotation exercise using the machine of FIGS. 1 to 10.
Figure 24A:
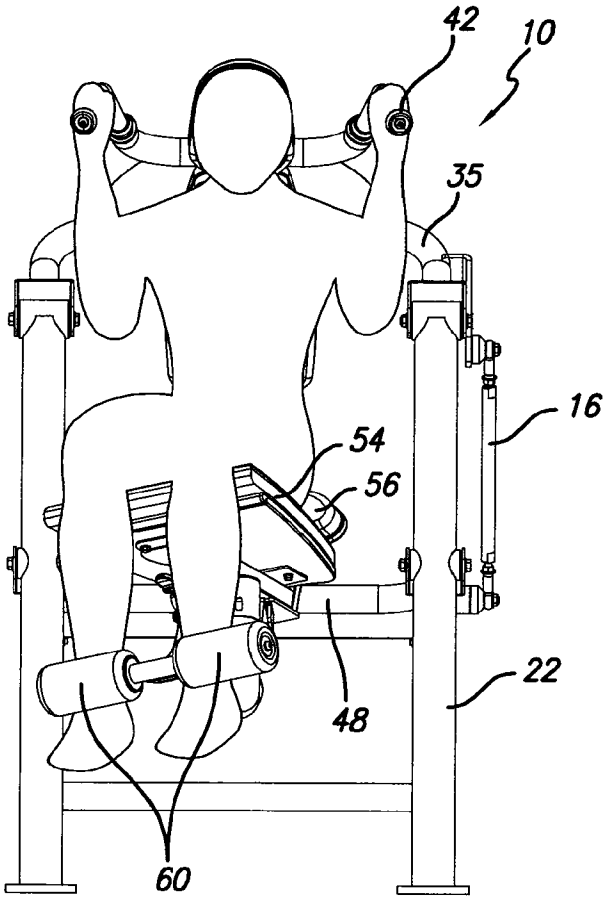

FIG. 24 illustrates opposite end positions of a torso rotation exercise. The user sits with their back against the back pad and the seat in an unlocked position with the knees to one side of the body. The user grasps the handles and places their feet behind the roller pads. The handles are pulled down until the crunch position of FIG. 7B is reached, and the crunch position is held while rotating the user support from side to side between the end positions of FIG. 24. At the end of the exercise, which can be determined by the user, the user slowly returns to the starting position.

As noted above, FIGS. 11A, 11B, 12A, and 12B show variations to the design of the stabilizing support or roller pads 60 found in FIGS. 1 to 10, with FIGS. 11A and 12A illustrating an exercise start position similar to FIG. 7A, and FIGS. 11B and 12B illustrating an exercise finish position similar to FIG. 7B. In FIG. 11, the roller pads 60 have been replaced by footplates 64, while in FIG. 12 the roller pads have been replaced by knee or shin pads 65. Regardless of the stabilizing support used, the purpose remains the same; to stabilize the user's lower leg and help in controlling the swiveling action of the user support assembly. Another slight difference in FIGS. 11 and 12 is that both designs show the user starting with the seat pad in a flat position, parallel to the horizontal centerline.

FIGS. 14 to 20 show a second embodiment of an abdominal crunch exercise machine 100 with a raised pivoting seat which can be rotated upwardly and downwardly and also swiveled from side to side. FIGS. 14A and 18A illustrate the start position for an abdominal crunch exercise, while FIGS. 14B and 18B illustrate the end position. While machine 100 is similar to the first embodiment, there are several differences. In this design, the load is supplied by a cable and pulley system connected to a selectorized weight stack 110 rather than hand loaded weight plates as in the previous embodiments. This load is connected to a modified user support movement arm 112 rather than to the exercise arm as in the first embodiment. Also the attachment point of the connecting link 16 to the user support movement arm assembly is adjustable rather than fixed. This allows the user to vary the amount of lift (vertical movement) to the user support by altering the pivotal action of the movement arm.

Figure 14A:
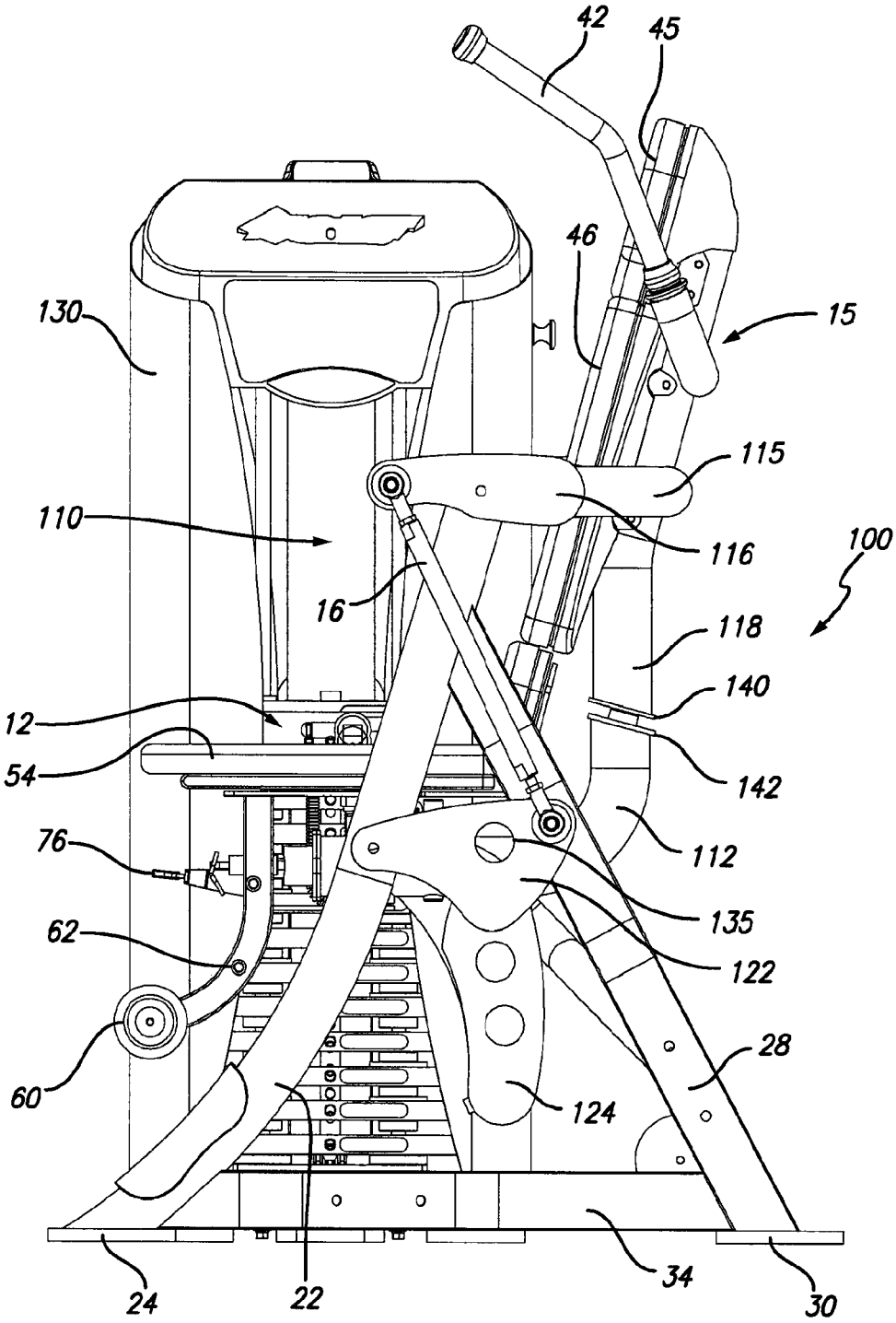
FIG. 14A is a side elevation view of another embodiment of a pivoting seat exercise machine in an exercise start position.
Figure 14B:
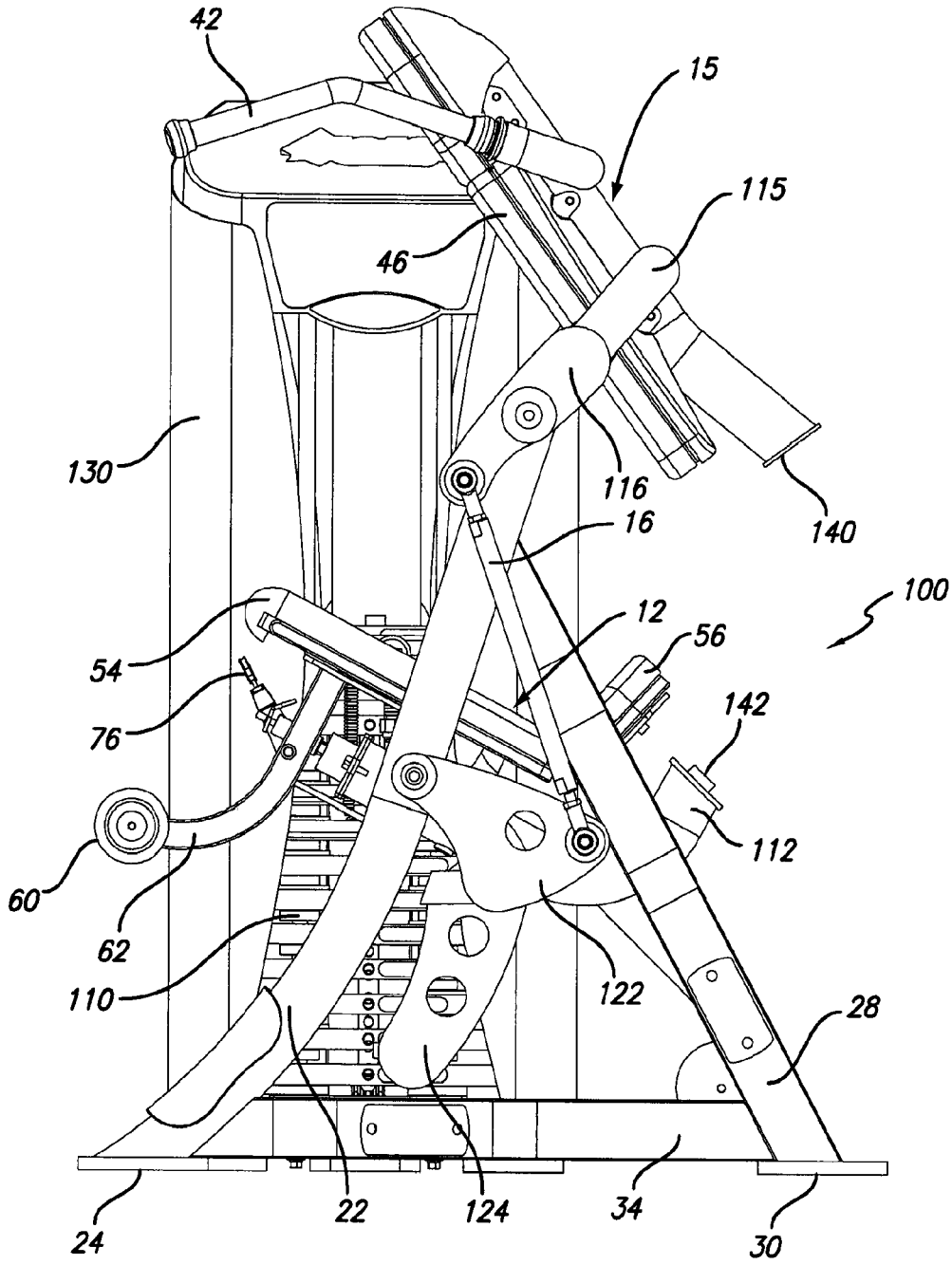
FIG. 14B is a side elevation view similar to FIG. 14A but illustrating an exercise end position.
Figure 15:
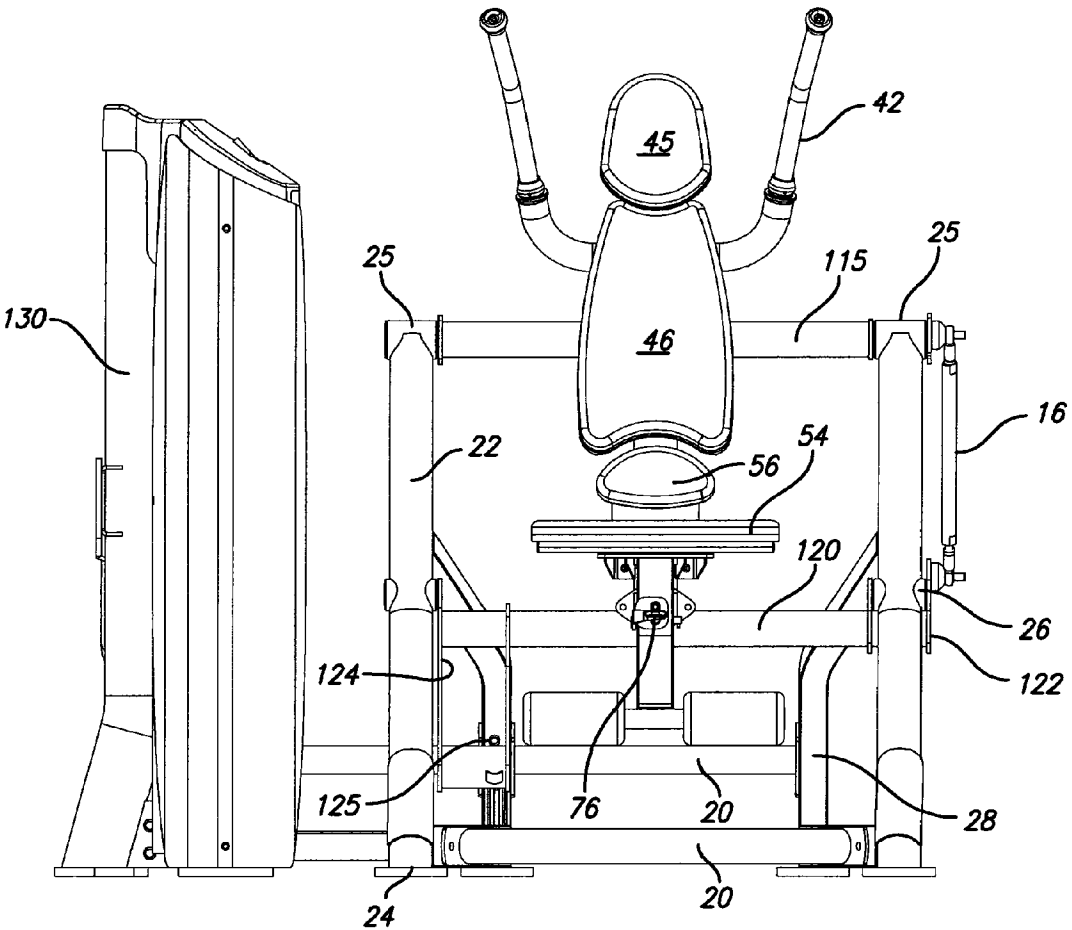
FIG. 15 is a front view of the machine in the position of FIG. 14A.
Figure 16:
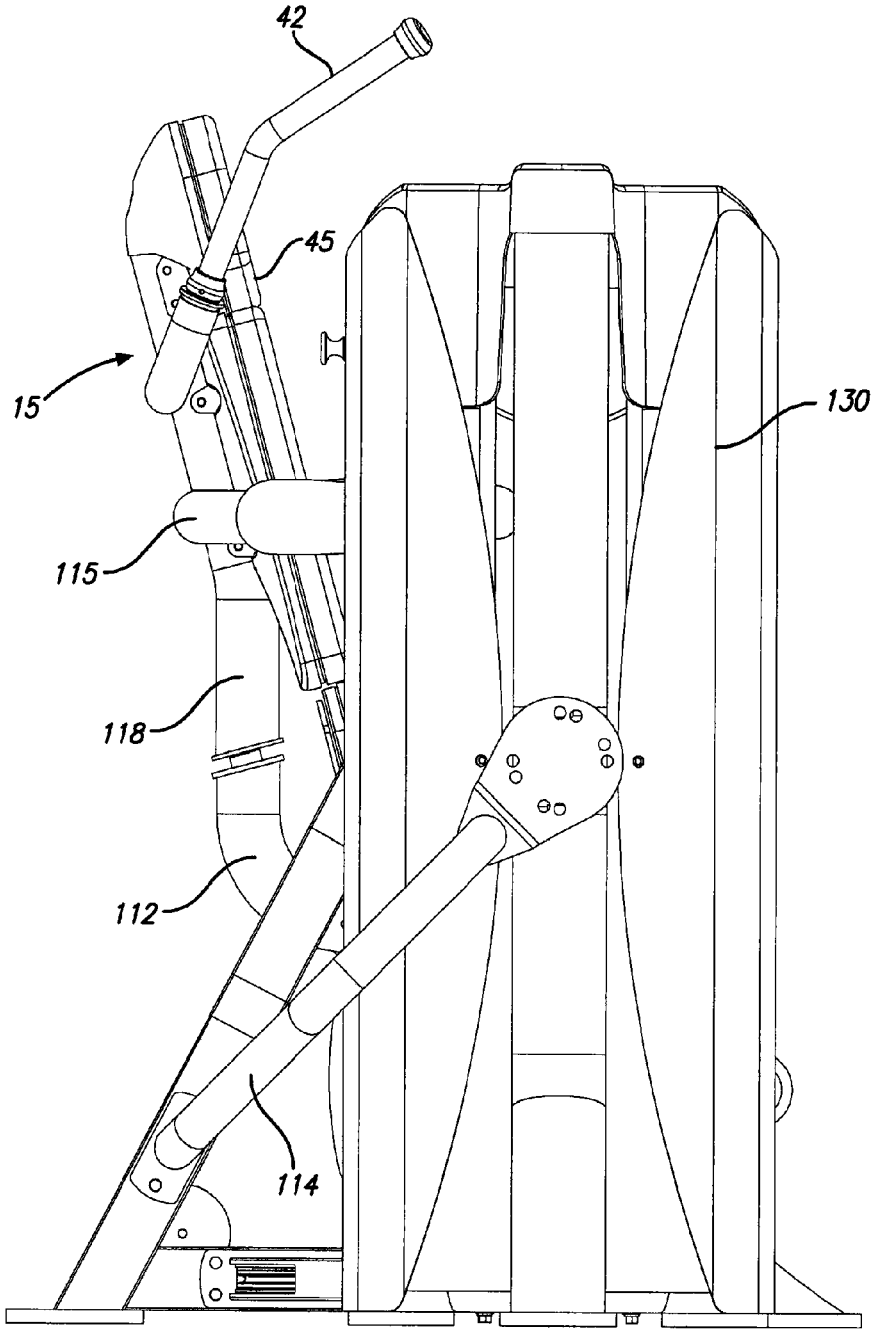
FIG. 16 is a second, opposite side elevation view of the machine of FIGS. 14 and 15.
Figure 17:
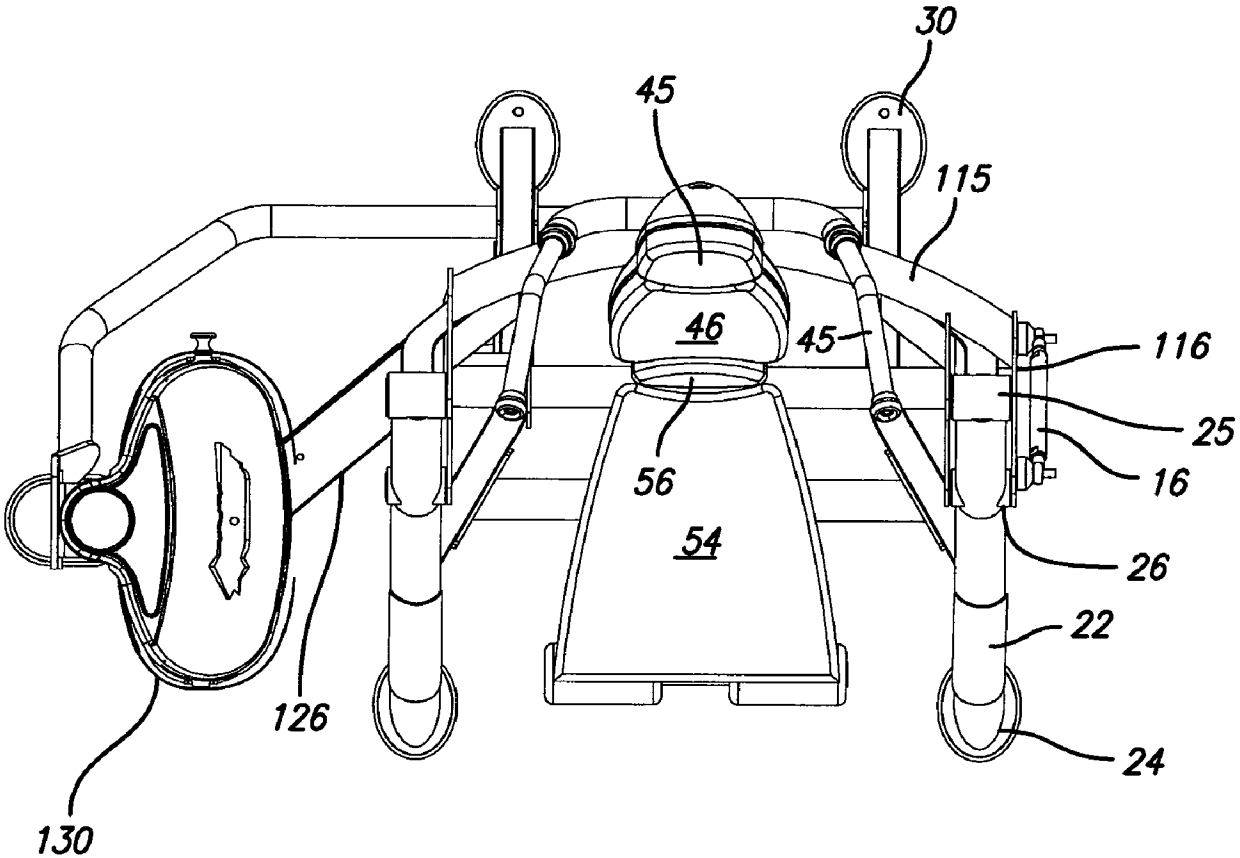
FIG. 17 is a top plan view of the machine of FIGS. 14 to 16.
Figure 18A:
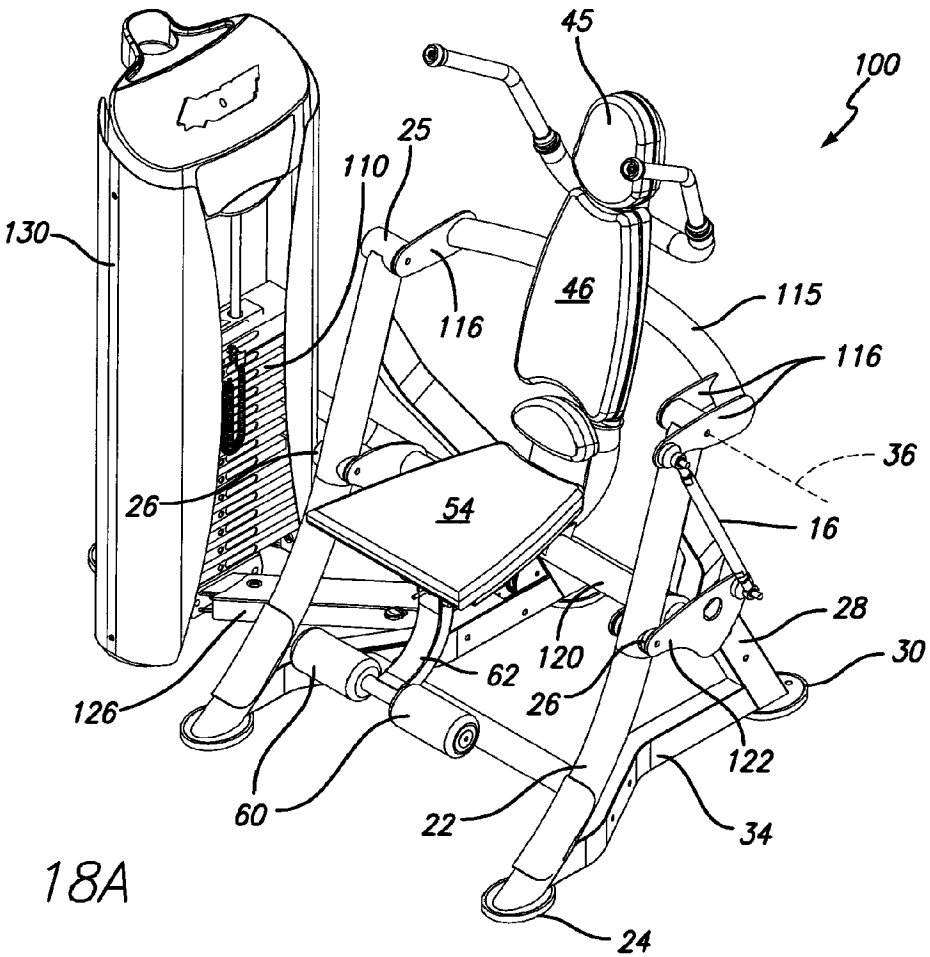
FIG. 18A is a front perspective view of the machine of FIGS. 14 to 17 in the start position of FIG. 14A.

In most other aspects the features and function are the same as in the previous embodiment of FIGS. 1 to 10, and like reference numbers have been used for like parts as appropriate. The main frame comprises right and left side sections joined together by first and second cross struts 20. Each side section has a main or front upright 22 with a floor engaging foot 24 at the lower end and a first pivot mount 25 approximate the upper end. A supporting or rear upright 28 is positioned rearward of the main upright and has a floor engaging foot 30 at the lower end. Supporting upright 28 is joined at the upper end to the main upright below the first pivot mount, as illustrated in FIGS. 14A and 18A. A support tube 34, positioned above the floor engaging feet, joins the front and rear uprights. A second pivot mount 26 is mounted on each front upright 22 below the upper pivot mount 25. The main frame is connected to the housing 130 of weight stack 110 by connecting strut 114 extending from the rear upright of the right hand side section, as illustrated in FIG. 19.

A first pivoting cross strut 115 has opposite ends pivotally connected to the first pivot mounts 25 on each main upright. The cross strut is curved rather than U-shaped as in the previous embodiment, and has pivot mounting brackets or plates 116 at each end which are pivotally connected to pivot mounts 25 for rotation about a first horizontal pivot axis 36 equivalent to the first pivot axis of the first embodiment. An exercise arm assembly 15 is mounted to the mid section of the first cross strut. The exercise arm assembly consists of vertically extending upright tube 118 with a pair of user engaging handles 42 mounted approximate the upper end of upright and user engaging head and upper back pads 45, 46 mounted on the front side of tube 118. Tube 118 is similar to the tube 40 of the previous embodiment but excludes the lower extension of the previous embodiment which carried the weight receiving peg 44.

A second pivoting cross strut 120, best seen in FIG. 19, has opposite ends pivotally mounted to second pivot mounts 26 on each main upright, at a location spaced below the first pivot mounts. The second cross strut is straight with a mounting bracket 122 at one end and an oversized mounting plate 124 at the other end facing the weight stack. A load receiving device 125 (FIG. 19) is mounted to the lower end of the oversized mounting plate. A cable (not illustrated) extending from the weight stack 110 through cable guide tube 126 is connected to the load receiving device. A connecting link 16 pivotally connects the outermost pivot brackets 116, 122 of the first and second cross struts, as seen in FIGS. 14A, 18A and 19.

Figure 19:
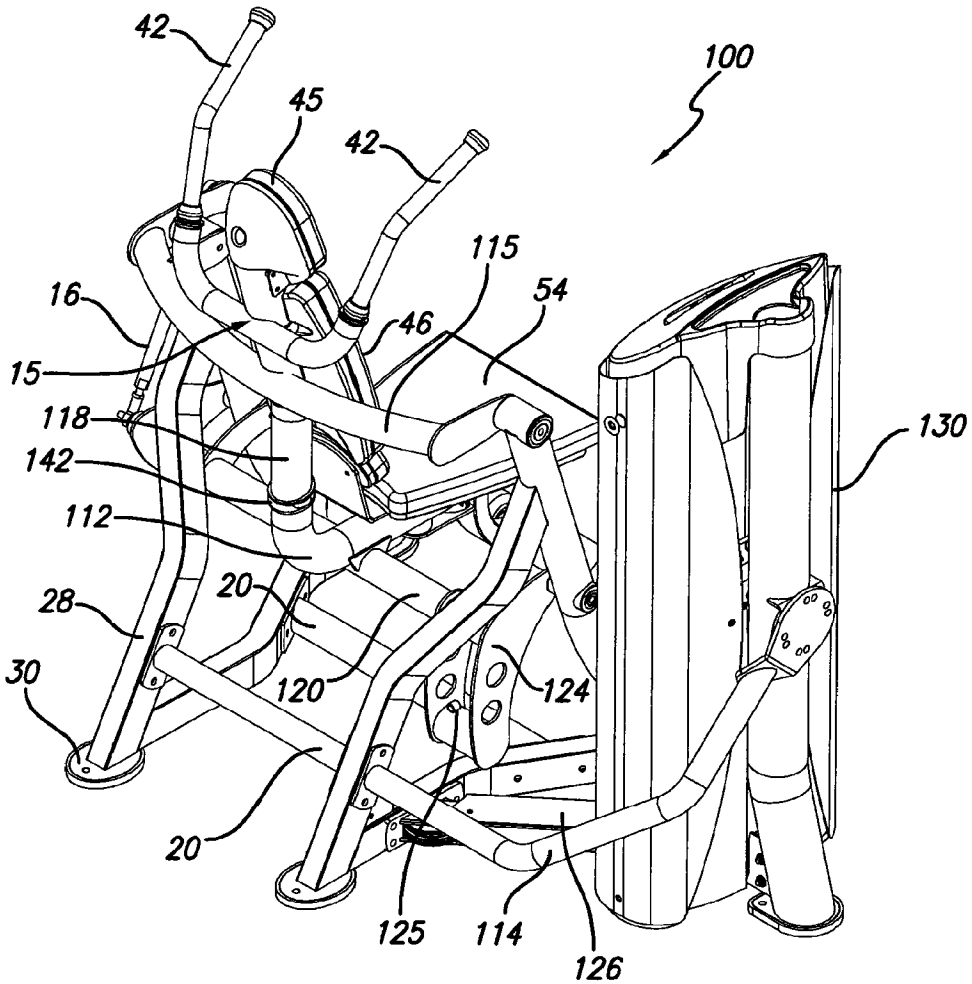
FIG. 19 is a rear perspective view of the machine of FIGS. 14 to 18.

User support movement arm 112 is mounted at the mid section of the second cross strut 120, as best seen in FIG. 19, and has a pivotal mounting 128 similar to that of the previous embodiment for receiving a user support assembly, the pivotal mounting 128 defining vertical pivot axis 75.

An upright frame 130 for housing selectorized weight stack 110 is connected to one side section of the main frame by cross strut 114 (FIG. 19). A cable reeved over pulleys connects the weight stack with the load receiving device 125 associated with the second pivoting cross strut 120.

In this embodiment, the user support assembly 12 has a base plate 55 for supporting a primary user support or seat pad 54, an upward projecting support plate 58 mounted approximate the rearward end of the base plate for supporting the secondary user support or tail bone pad 56, and a downward projecting support tube 62 mounted approximate the forward end of the base plate for supporting the stabilizing support or roller pads 60. As in the previous embodiment, roller pads 60 may be replaced with alternative stabilizing supports such as those illustrated in FIGS. 11 and 12. A pivot axle 63 as illustrated in FIGS. 13*a* and 13*b* for the previous embodiment is mounted to the base tube between the upward and downward projecting support tubes, and rotatably connects the user support assembly to the user support movement arm. In this embodiment, the primary user support 54 comprises a seat pad, the secondary user support 56 comprises a tail bone pad and the stabilizing support 60 comprises a pair of roller pads transversely mounted on the downward projecting support tube.

In this embodiment, the upright tube 118 of the exercise arm assembly has a bumper pad 140 at its lower end. The rear end of user support movement arm 112 is bent upwardly and has a bumper pad 142 at its upper end. The bumper pads 140, 142 can be seen separated in the exercise end position of FIGS. 14A and 19A, and are engaged when the machine is in the exercise start position, as illustrated in FIGS. 14A, 19A and 20.

To prevent the user support seat (or the user seated in the seat) from contacting the main frame when the support seat swivels about pivot axis 75, stops can be placed to limit the side to side pivot. Just as in the first embodiment, a locking device 76 may be used to temporarily secure the seat in a centered, forward facing orientation for ease of entering and exiting.

To perform an exercise, the user sits on the seat (primary support) with their buttock up against the tail bone pad (secondary support), knees bent over the front edge of the seat pad and their feet hooked behind the stabilizing roller pads, with the seat and exercise arm in the position of FIGS. 14A and 18A. They then unlock the user support assembly (if needed), lean back against the user engaging pads on the exercise arm, grab the user engaging handles and pull the handles forward in a downward motion. This action forces the user engaging pads to contact the user's head, upper back and shoulders, pushing them forward and downward and causing the user's upper body to bend just below the rib cage and activate the upper abdominal muscles. This also forces the connecting link 16 attached to the exercise arm to induce movement in the user support movement arm 112 and lift the arm upward in a rearward direction, which in turn lifts the user support seat 54 upward and rearward, in the same way as illustrated in FIGS. 7A and 7B for the previous embodiment, finishing with the exercise arm and seat in the position illustrated in FIGS. 14B and 18B. This movement lifts the user's knees while it lowers the user's hips, causing the user to bend forward at the waist, thereby activating the lower abdominal muscles. Partial resistance is supplied by the weight of the user seated on the user support, which is raised at the front end when the exercise arm is moved. Again, this resistance is only slight because part of the user's body weight passes through the gravitational center line 82 (see FIGS. 7A and 7B) as the user support lifts at its forward end. Additional resistance is supplied by selecting the appropriate amount of weight on the weight stack. This vertical movement to the user support is automatic because the upper pivoting exercise arm and lower pivoting user support movement arm are directly linked via the connecting link.

Figure 18B:
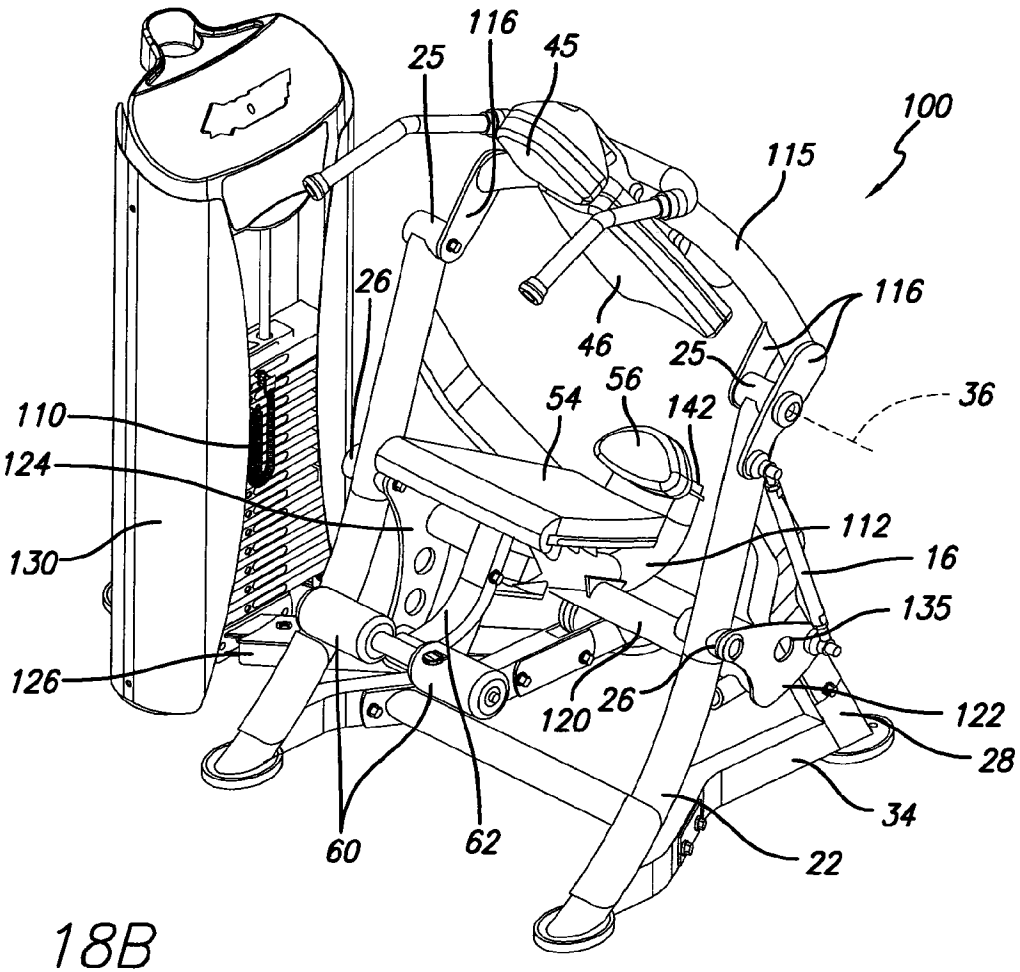
FIG. 18B is front perspective view similar to FIG. 18A but illustrating the end position of FIG. 14B.

FIGS. 18A and 18B illustrate an exercise in which seat 54 is held in a central position by the user during the exercise, using core stabilizing muscles to prevent swiveling of the seat. Alternatively, as in the previous embodiment, seat 54 can be swiveled during an exercise or held in a swiveled, non central orientation throughout the exercise, in order to exercise different muscles.

Figure 20B:
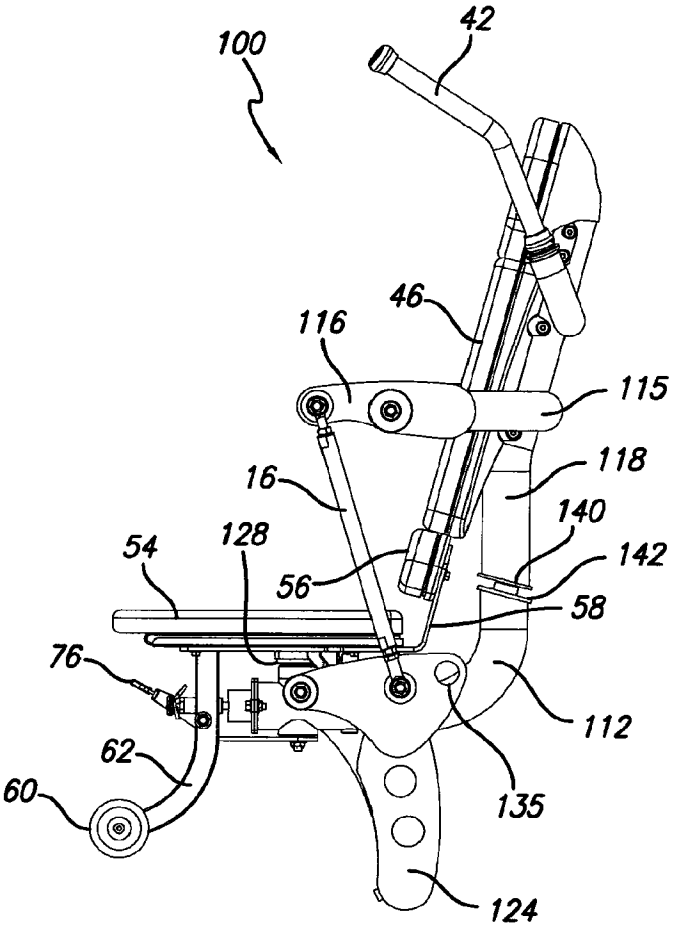
FIGS. 20A and 20B are side elevation views of the user support assembly and exercise arm of the embodiment of FIGS. 14 to 19 separate from the support frame and weight stack, illustrating the connecting link pivotally attached to two different points on the pivoting cross strut.
Figure 20A:
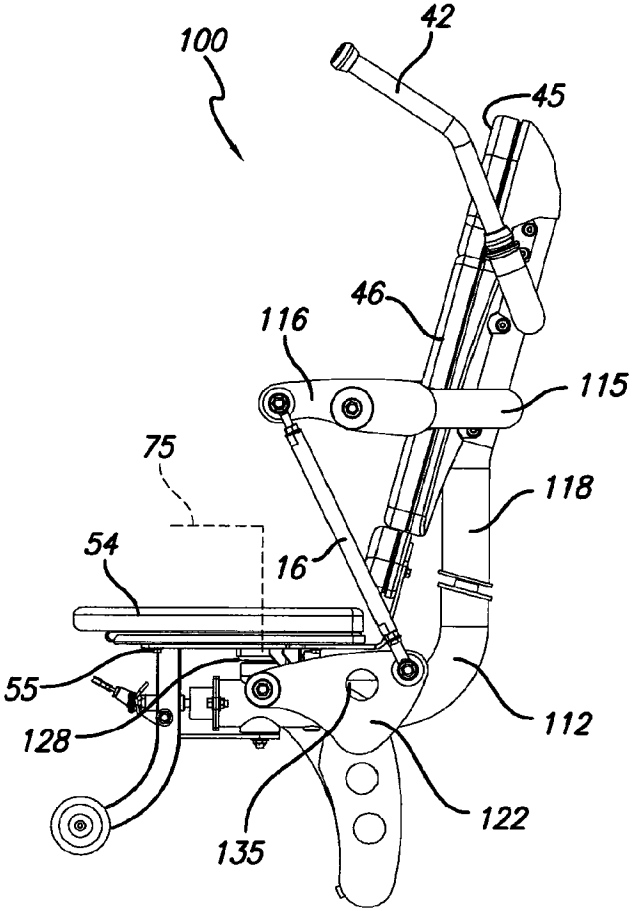

Altering the amount of pivotal movement in the lower cross strut 120 affects the exercise resistance. The less the user support moves vertically relative to movement in the exercise arm, the less the user's body weight is involved in the exercise, and less load-bearing cable will also be pulled, since in this embodiment the load is connected to the user support arm 112. In the illustrated embodiment, the lower cross strut is linked to the load and the connection point between the lower end of the connecting link 16 and the lower cross strut can be varied as illustrated in FIGS. 20A and 20B, by connecting the lower end of the strut to a selected one of the openings 135 in pivot bracket 122 at one end of cross strut 120. In another embodiment, one or more additional openings for connecting to the upper end of the link 16 may be provided in the pivot bracket 116 at the end of the upper cross strut 115, either instead of or in addition to the additional pivot connection opening 135 for the connecting link on the bracket of the lower cross strut. The connection point of the connecting link 16 on either pivoting cross strut 115, 120 can be adjusted to vary the effect that movement of the exercise arm has on the movement of the user support and, depending on which cross strut is connected to the load, how much weight is lifted. In this case, the lower connection point between the link and the second pivoting cross strut is adjustable.

FIGS. 20A and 20B illustrate adjustment of the pivotal attachment point between the connecting link 16 and the end of the lower cross strut 120. In FIG. 20A, the connecting link 16 is pivotally attached to the right hand opening 135, while in FIG. 20B it is attached to the left hand opening 135. This adjustment alters the amount of vertical movement in the user support, and also affects the amount of resistance felt by the user in several ways. First, the amount of resistance added by the user's body weight changes, since the less the vertical movement, the less the user's weight acts as a resistance. Second, when the resistance is associated with the movement of the lower cross strut which is connected to the user support movement arm, as in the embodiment of FIGS. 14 to 20, altering the amount of movement of that cross strut alters how much the load is displaced.

In both of the above embodiments, side-to-side swiveling movement of the user support is provided by its pivotal connection to the movement arm. This is an unrestricted, free-swiveling movement that is controlled by the user. It allows the user to pivot the seat from side to side as the movement arm is being pivoted, involving a greater number of torso muscles. Swiveling the knees to one side or the other involves the oblique muscles as well as the upper and lower abdominal muscles as well as core stabilizing muscles in the abdominal and low back. The end result is an exercise machine that utilizes both a resistive, load bearing movement and free swiveling, user defined movement and combines the four basic torso exercises; Abdominal Crunch, Leg Raise, Side Bend and Trunk Rotation, into one exercise movement.

The exercise machines shown in the above embodiments work particularly well in an abdominal crunch movement where the user's upper body wants to move towards their lower body. However it should be understood that these machines can be adapted to other exercise movements. These movements could be designed to exercise muscles in the upper or lower body, and could have the user's upper body moving towards their lower body, away from their lower body or in a fixed relationship to the position of their lower body and still provide the same effects. Balancing on a moving seat and controlling its swiveling action requires core stabilizing muscles in the abdominal and low back area to become involved regardless of the type of exercise being performed.

It should be understood that all the different elements used in the various embodiments may be mixed and interchanged with one another. Any of the user support pads or exercise arm pads could be made adjustable; various types of user engaging handles could be used; the exercise arm could be unidirectional or bi-directional; the connecting link could be made adjustable, the solid link could be replaced with a flexible one; and the connecting link could be made to push or pull to urge rotation of the user support. The resistance may be associated with any of the moving parts (user support, exercise arm or connecting link).

It should also be noted that different types and forms of components could be used in the above embodiments without affecting the scope of this invention. Cables could be replaced with belts, ropes, chains or the like, pulleys replaced with sprockets, and tubes could be replaced with solid rods or bars. Other types of resistance known to the art could by used in place of the weight plates of FIGS. 1 to 13 or the weight stack of FIGS. 14 to 20, such as hydraulic, pneumatic, electromagnetic or elastic bands resistance devices.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. An exercise machine, comprising:

a support frame having a forward end, a rear end, a left side and a right side;

a user support movement arm pivoted on the frame for rotation in a first direction about a first pivot axis;

a user support assembly which is adapted to support a user in an exercise position while performing an exercise, the user support assembly pivotally mounted on the user support movement arm for rotation about a second pivot axis between right and left end positions, the user support assembly having a central, forward facing position between the right and left end positions;

at least one exercise arm pivotally mounted for rotation about an additional pivot axis;

a connecting linkage which translates movement of said at least one exercise arm into movement of the user support movement arm and user support assembly in the first direction during an exercise; and the user support assembly being configured for free rotational movement about the second pivot axis in opposite directions between the right and left end positions and through the central, forward facing position simultaneously with rotation of the exercise arm about the additional pivot axis to rotate the user support movement arm about the first pivot axis, whereby rotation of the user support assembly about the second pivot axis comprises a user controlled, free pivoting movement between the right and left end positions through the central, forward facing position.

2. The machine of claim 1, further comprising a load connected to at least one of the exercise arm, user support movement arm, and user support assembly.

3. The machine of claim 1, wherein the user support assembly has a primary support and a secondary support which are configured to support different parts of a user's body when in an exercise position on the user support assembly, and which travel together during an exercise movement.

4. The machine of claim 3, wherein the primary support comprises a seat pad and the secondary support comprises a tail bone pad, and the tail bone pad and seat pad rotate together about the second pivot axis.

5. The machine of claim 3, wherein the primary support comprises a seat pad and the secondary support comprises a leg stabilizer.

6. The machine of claim 3, wherein the user support assembly has a stabilizing support which supports a different part of the user's body from the primary and secondary supports and which travels together with the primary and secondary supports during an exercise movement.

7. The machine of claim 6, wherein the primary support comprises a seat pad, the secondary support comprises a tail bone pad, and the stabilizing support comprises a leg stabilizer.

8. The machine of claim 7, wherein the stabilizing support comprises roller pads which are adapted to be engaged over a user's feet when a user is positioned on the primary and secondary supports.

9. The machine of claim 7, wherein the stabilizing support comprises at least one foot engaging plate.

10. The machine of claim 7, wherein the stabilizing support comprises knee pads which are adapted to be engaged with the front of the user's shins.

11. The machine of claim 1, wherein the exercise arm is an upper torso engaging assembly having a back pad and user engaging handles.

12. The machine of claim 1, wherein the first and second directions of movement are in different planes.

13. The machine of claim 12, wherein the first direction of movement is in a vertical plane.

14. The machine of claim 1, wherein the connecting linkage is adjustable.

15. The machine of claim 1, wherein the user support assembly is configured to support a user in a seated position, the exercise arm is an upper torso engaging assembly, and rotation of the exercise arm from a start position in an exercise movement moves the user support assembly towards the upper torso engaging assembly in an abdominal crunch exercise.

16. The machine as claimed in claim 1, wherein the second pivot axis is non-parallel to the first and the additional pivot axis.

17. An exercise machine, comprising:

a support frame;

a first moving part comprising a user support movement arm pivoted on the frame for rotation in a first direction about a first pivot axis;

a second moving part comprising a user support assembly pivotally mounted on the user support movement arm for rotation in opposite directions about a second pivot axis, the user support assembly having at least a primary support comprising a seat pad and a secondary support comprising a tail bone pad which are adapted to be engaged with different parts of a user's body when in an exercise position on the user support assembly, and both supports travel together about the second pivot axis;

a third moving part comprising at least one exercise arm pivotally mounted for rotation about at least one additional pivot axis;

at least one connecting link associated with at least two of the moving parts which translates movement of said one exercise arm into movement of the user support movement arm and user support assembly about the first pivot axis; and rotation about at least one of the first and second pivot axes comprising a user-controlled, free-pivoting movement throughout the exercise.

18. The machine of claim 17, wherein the user support assembly has an additional, stabilizing support which is configured to be engaged with a different part of the user's body from the primary and secondary supports and which travels together with the primary and secondary supports about the second pivot axis.

19. The machine of claim 18, wherein the stabilizing support comprises a leg stabilizer.

20. The machine of claim 17, wherein the user support assembly is configured for free swiveling movement about the second pivot axis between right and left swiveled end positions, the swiveling movement comprising a user controlled, unrestricted free swiveling movement of the seat pad and tail bone pad between the right and left end positions throughout an exercise.

21. The machine of claim 20, wherein the exercise arm is an upper torso engaging assembly having a back pad and user engaging handles, and user controlled, free swiveling of the user support assembly about the second pivot axis during an exercise swivels the user's lower torso relative to their upper torso.

22. The machine of claim 17, further comprising a load linked to at least one of the exercise arm, connecting link and user support movement arm.

23. The machine of claim 1, wherein the first pivot axis is a horizontal pivot axis;

the second pivot axis is non-parallel to the first pivot axis, the user support assembly being configured to support a user in a seated position during an exercise;

the exercise arm is pivotally mounted above the user support assembly and the additional pivot axis is parallel to the first pivot axis, the exercise arm having handles which are configured to be gripped by a user when performing an abdominal exercise; and the connecting linkage is between the exercise arm and user support movement arm and translates movement of the exercise arm in a first direction about the additional pivot axis to rotation of the user support movement arm and user support assembly about the first pivot axis in a second direction opposite to the first direction, so as to perform an abdominal exercise.

24. An abdominal exercise machine, comprising:

a support frame;

a user support movement arm pivoted on the frame for rotation about a first, horizontal pivot axis;

a user support assembly pivotally mounted on the user support movement arm and configured for rotation in opposite directions between right and left end positions about a second pivot axis non-parallel to the first pivot axis, the user support assembly being configured to support a user in a seated position during an exercise and having a central, forward facing position between the right and left end positions;

the user support assembly having a primary support and a secondary support which are configured to be engaged with different parts of a user's body when the user is in an exercise position on the user support assembly, and which travel together during an exercise;

the primary support composing a seat pad and the secondary support comprising a tail bone pad, whereby the tail bone pad and seat pad rotate together about the second pivot axis;

an exercise arm pivotally mounted above the user support assembly for rotation about a third pivot axis parallel to the first pivot axis, the exercise arm having handles which are configured to be gripped by a user when performing an abdominal exercise;

a connecting link between the exercise arm and user support movement arm which translates movement of the exercise arm in a first direction about the third pivot axis to rotation of the user support movement arm and user support assembly about the first pivot axis in a second direction opposite to the first direction, so as to perform an abdominal exercise; and the user support assembly being free to swivel about the second pivot axis between the right and left and positions and through the central, forward facing position throughout the abdominal exercise, whereby a user seated on the user support assembly can control free swiveling movement of the user support assembly throughout the exercise using core stabilizing muscles.

25. The machine of claim 24, wherein the user support assembly has a stabilizing support which is configured to be engaged with a different part of the user's body from the primary and secondary supports and which travels together with the primary and secondary supports during an exercise movement.

26. The machine of claim 25, wherein the stabilizing support comprises a leg stabilizer.

27. The machine of claim 26, wherein the leg stabilizer comprises roller pads which are adapted to be engaged over a user's feet when positioned on the user support assembly.

28. The machine of claim 25, wherein the stabilizing support comprises at least one foot engaging plate.

29. The machine of claim 25, wherein the stabilizing support comprises knee pads which are adapted to be engaged with the front of the user's shins.

30. The machine of claim 24, wherein the exercise arm is an upper torso engaging assembly having a back pad, the user engaging handles extending on opposite sides of the back pad.

31. The machine of claim 30, further comprising a support post on the user support assembly which secures the tail bone pad to the user support assembly, the tail bone pad being aligned with the back pad in an inoperative, rest position of the exercise arm and user support movement arm.

32. The machine of claim 31, wherein the support frame has opposite right and left side supports on opposite sides of the user support assembly, and a cross support spaced from the support post and tail bone pad extends between the side supports and is pivotally mounted between the side supports for rotation about the first pivot axis, the user support movement arm being secured to the cross support and extending forward from the cross support beneath the user support assembly.

33. An exercise machine, comprising:

a support frame having a forward end, a rear end, a left side and a right side;

a user support movement arm pivoted on the frame for rotation in a first direction about a first pivot axis;

a user support assembly which is adapted to support a user in an exercise position while performing an exercise, the user support assembly pivotally mounted on the user support movement arm for rotation in opposite directions about a second pivot axis between right and left end positions, the user support assembly having a central, forward facing position between the right and left end positions;

at least one exercise arm pivotally mounted for rotation about an additional pivot axis;

a connecting linkage which translates movement between said at least one exercise arm and said user support movement arm and user support assembly during an exercise; and the user support assembly being configured for free rotational movement about the second pivot axis in opposite directions between the right and left end positions and through the central, forward facing position simultaneously with rotation of the exercise arm about the additional pivot axis to rotate the user support movement arm about the first pivot axis, whereby rotation of the user support assembly about the second pivot axis comprises a user controlled, free pivoting movement between the right and left end positions through the central, forward facing position.

* * * * *